US011215945B2

(12) United States Patent
Ishii et al.

(10) Patent No.: US 11,215,945 B2
(45) Date of Patent: Jan. 4, 2022

(54) OPTICAL SENSOR AND IMAGE FORMING APPARATUS

(71) Applicant: RICOH COMPANY, LTD., Tokyo (JP)

(72) Inventors: Toshihiro Ishii, Miyagi (JP); Yoshihiro Oba, Miyagi (JP); Fumikazu Hoshi, Miyagi (JP); Satoru Sugawara, Miyagi (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/789,144

(22) Filed: Feb. 12, 2020

(65) Prior Publication Data

US 2020/0183314 A1 Jun. 11, 2020

Related U.S. Application Data

(63) Continuation of application No. 15/600,191, filed on May 19, 2017, now Pat. No. 10,606,204, which is a (Continued)

(30) Foreign Application Priority Data

Aug. 28, 2012 (JP) ..... JP2012-187596

(51) Int. Cl.
*G03G 15/11* (2006.01)
*G03G 15/00* (2006.01)

(52) U.S. Cl.
CPC ..... *G03G 15/5062* (2013.01); *G03G 15/5025* (2013.01); *G03G 15/5029* (2013.01); (Continued)

(58) Field of Classification Search
CPC ..... G03G 15/5062; G03G 15/5029; G03G 15/5025; G03G 2215/00738; (Continued)

(56) References Cited

U.S. PATENT DOCUMENTS 5,109,236 A 4/1992 Watanabe et al.
5,963,328 A 10/1999 Yoshida et al.
(Continued)

FOREIGN PATENT DOCUMENTS

CA 2 817 190 A1 5/2012
CN 1595308 A 3/2005
(Continued)

OTHER PUBLICATIONS

Dec. 27, 2018, Indian official action in connection with corresponding Indian patent application No. 224/MUMNP/2015.
(Continued)

*Primary Examiner* — Tony Ko
(74) *Attorney, Agent, or Firm* — Xsensus LLP

(57) ABSTRACT

An optical sensor includes a light source; and an optical detector detecting intensity of light that is reflected by a recording medium, the light from the light source and irradiated onto the recording medium. Further, when an incident angle of the light incident to the recording medium from the light source relative to a normal line of the recording medium is given as θ1, a formula 75°≤θ1≤85° is satisfied.

13 Claims, 27 Drawing Sheets

Related U.S. Application Data continuation of application No. 14/418,656, filed as application No. PCT/JP2013/065305 on May 28, 2013, now Pat. No. 9,696,674.

(52) U.S. Cl.
CPC ..... *G03G 2215/00738* (2013.01); *G03G 2215/00751* (2013.01)

(58) Field of Classification Search
CPC ..... G03G 2215/00751; G03G 15/0855; G03G 15/0848; G03G 21/20
See application file for complete search history.

(56) References Cited

U.S. PATENT DOCUMENTS

| | | | | |
|---|---|---|---|---|
| 6,731,886 | B2 | 5/2004 | Takeda | |
| 7,109,507 | B2 | 9/2006 | Yamaguchi | |
| 7,582,888 | B2 | 9/2009 | Shinno et al. | |
| 8,750,732 | B2 | 6/2014 | Ishii et al. | |
| 2004/0129901 | A1* | 7/2004 | Yamaguchi | B41J 11/0095 250/559.07 |
| 2005/0201808 | A1 | 9/2005 | Barry et al. | |
| 2007/0070351 | A1 | 3/2007 | Nou et al. | |
| 2008/0143793 | A1 | 6/2008 | Okuda | |
| 2009/0196641 | A1* | 8/2009 | Banton | G03G 15/5062 399/67 |
| 2010/0008684 | A1* | 1/2010 | Matsumoto | G03G 15/0822 399/45 |
| 2010/0238238 | A1 | 9/2010 | Yamamoto | |
| 2011/0236266 | A1 | 9/2011 | Uematsu et al. | |
| 2013/0216245 | A1 | 8/2013 | Hoshi et al. | |
| 2013/0216246 | A1 | 8/2013 | Hoshi et al. | |
| 2013/0216247 | A1 | 8/2013 | Oba et al. | |
| 2013/0228674 | A1 | 9/2013 | Oba et al. | |
| 2013/0235377 | A1 | 9/2013 | Ishii et al. | |
| 2013/0259500 | A1 | 10/2013 | Regelsberger | |
| 2014/0359985 | A1 | 12/2014 | Yamamoto | |

FOREIGN PATENT DOCUMENTS

| | | | |
|---|---|---|---|
| CN | 102200504 | A | 9/2011 |
| EP | 1 936 358 | A1 | 6/2008 |
| JP | H02-138805 | | 5/1990 |
| JP | H08-005573 | | 1/1996 |
| JP | H10-160687 | | 6/1998 |
| JP | H11-249353 | | 9/1999 |
| JP | H11-304703 | | 11/1999 |
| JP | 2002-340518 | | 11/2002 |
| JP | 3349069 | | 11/2002 |
| JP | 2003-292170 | | 10/2003 |
| JP | 2005-083850 | | 3/2005 |
| JP | 2005-156380 | | 6/2005 |
| JP | 2006-062842 | | 3/2006 |
| JP | 2006-064496 | | 3/2006 |
| JP | 2006-170925 | | 6/2006 |
| JP | 2007-085963 | | 4/2007 |
| JP | 2007-187570 | | 7/2007 |
| JP | 2008-149579 | | 7/2008 |
| JP | 2008-157648 | | 7/2008 |
| JP | 2010-214847 | | 9/2010 |
| JP | 2012-6224 | | 1/2012 |
| JP | 2012-40776 | | 3/2012 |
| JP | 2012-127937 | | 7/2012 |
| JP | 2012-194445 | | 10/2012 |
| WO | WO2012/070693 | A1 | 5/2012 |

OTHER PUBLICATIONS

Sep. 4, 2018 Japanese official action in connection with corresponding Japanese patent application No. 2014-266869.
Feb. 9, 2016 European Search Report in connection with European patent application No. 13833648.2.
International Search Report dated Jun. 25, 2013 In PCT/JP2013/065305 filed on May 28, 2013.
Mar. 8, 2017 Chinese official action (and translation thereof into English) in connection with corresponding Chinese patent application No. 2013800500186.
Combined Chinese Office Action and Search Report dated Mar. 10, 2021 in Chinese Patent Application No. 201910005138.3 (with English translation), 18 pages.

* cited by examiner

FIG.6

| | FIXING | | | TRANSFER | FEED |
|---|---|---|---|---|---|
| SMOOTHNESS (sec) | TEMPERATURE (°C) | LINE SPEED (STEP) | NIP WIDTH | CURRENT VALUE | LINE SPEED (STEP) |
| 20 | 200 | 1 | 10 | 10 | 1 |
| 40 | 190 | 1 | 10 | 10 | 1 |
| 60 | 180 | 1 | 10 | 10 | 2 |
| 80 | 160 | 2 | 10 | 10 | 2 |
| 100 | 150 | 2 | 10 | 10 | 2 |
| 120 | 140 | 3 | 12 | 10 | 2 |
| 140 | 130 | 3 | 12 | 20 | 3 |
| 160 | 120 | 3 | 12 | 20 | 3 |

FIG.20

| | | LIGHT AMOUNT MEASUREMENT | | SMOOTHNESS MEASUREMENT |
|---|---|---|---|---|
| BRAND | MEASUREMENT POINT | REGULAR REFLECTION LIGHT DETECTOR | DIFFUSE REFLECTION LIGHT DETECTOR | SMOOTHNESS [s] |
| A | 1 | 65.2 | 33.4 | 95 |
| A | 2 | 62.2 | 33.4 | 89 |
| A | 3 | 60.9 | 35.0 | 86 |
| B | 1 | 58.9 | 32.8 | 98 |
| B | 2 | 60.7 | 32.7 | 89 |
| B | 3 | 66.5 | 30.7 | 95 |
| C | 1 | 52.3 | 32.8 | 92 |
| C | 2 | 53.1 | 31.8 | 86 |
| C | 3 | 53.8 | 31.4 | 92 |
| D | 1 | 34.5 | 36.7 | 31 |
| D | 2 | 30.2 | 37.5 | 29 |
| D | 3 | 33.2 | 36.5 | 27 |
| E | 1 | 74.4 | 34.1 | 130 |
| E | 2 | 73.5 | 33.5 | 128 |
| E | 3 | 78.3 | 33.9 | 128 |
| F | 1 | 80.1 | 34.1 | 80 |
| F | 2 | 81.2 | 34.6 | 97 |
| F | 3 | 70.3 | 34.4 | 71 |
| G | 1 | 41.2 | 32.8 | 46 |
| G | 2 | 41.2 | 32.8 | 45 |
| G | 3 | 41.2 | 31.1 | 47 |
| H | 1 | 24.3 | 36.9 | 20 |
| H | 2 | 25.3 | 36.8 | 22 |
| H | 3 | 24.7 | 37.3 | 20 |
| I | 1 | 40.6 | 33.3 | 45 |
| I | 2 | 45.4 | 32.6 | 48 |
| I | 3 | 41.8 | 32.0 | 48 |
| J | 1 | 24.1 | 38.1 | 18 |
| J | 2 | 24.1 | 37.2 | 19 |
| J | 3 | 22.6 | 36.1 | 19 |
| K | 1 | 33.0 | 37.6 | 20 |
| K | 2 | 38.1 | 36.1 | 24 |
| K | 3 | 36.4 | 38.1 | 24 |

FIG.26

| RANK | SHEET TYPE | OUTPUT OF REGULAR REFLECTION LIGHT DETECTOR | OUTPUT OF DIFFUSE REFLECTION LIGHT DETECTOR | SHEET THICKNESS (um) | ERROR | SMOOTHNESS |
|---|---|---|---|---|---|---|
| 1 | D | 86 | 32 | 110 | 0.1 | 30 |
| 2 | B | 85 | 31 | 110 | 0.3 | 50 |
| 3 | F | 96 | 38 | 120 | 0.5 | 45 |
| 4 | C | 100 | 35 | 90 | 0.7 | 110 |
| 5 | E | 85 | 39 | 150 | 0.9 | 60 |
| 6 | A | 63 | 37 | 80 | 1.1 | 80 |
| 7 | H | 35 | 32 | 70 | 1.3 | 90 |
| 8 | G | 75 | 35 | 100 | 1.5 | 90 |

OPTICAL SENSOR AND IMAGE FORMING APPARATUS

CROSS-REFERENCE TO RELATED APPLICATIONS

This application is a continuation of application Ser. No. 15/600,191, filed May 19, 2017, which is a continuation application Ser. No. 14/418,656, filed Jan. 30, 2015 (now U.S. Pat. No. 9,696,674), as a Section 371 national stage of International Application No. PCT/JP2013/065305 filed on May 28, 2013 and claims priority of Japanese Patent Application 2012-187596, filed Aug. 28, 2012. The entire contents of the above-identified applications are incorporated herein by reference.

TECHNICAL FIELD

The present invention relates to an optical sensor and an image forming apparatus.

BACKGROUND ART

In an image forming apparatus employing a so-called "electrophotographic method" such as a digital copier and a laser printer, an image is formed by transferring a toner image onto a recording medium such as recording paper and by fixing the toner image onto the recording medium such as the recording paper by heating and pressing under predetermined conditions. In such an image forming apparatus, it is desired to determine desirable conditions of the heating and pressing when the toner image is fixed. Especially, to form a high-quality image, it may be desired to separately set the fixing conditions of the toner image in accordance with the type (kind) of the recording medium.

This is because the image quality to be recorded (formed) on the recording medium may be greatly influenced by, for example, the material, thickness, humidity, smoothness, coating condition and the like of the recording medium. For example, in terms of the smoothness, the convexo-concave degree of the recording medium may vary depending on the fixing conditions. As a result, a toner fixation rate may be decreased at a concave part of the recording medium, and accordingly, it may become difficult to acquire a high-quality image. Namely, if an image is formed without using an appropriate fixing condition which is to be determined based on the actual smoothness of the recording medium on which the image is to be formed, color irregularity may occur, and it may become difficult to acquire a high-quality image.

On the other hand, with a recent progress of an image forming apparatus and a diversification of the expressions, the number of the types of the recording sheets which become the recording media has been increased to more than several hundreds. Further, in each type of the recording sheets, there are so many brands in the recording sheets which differ from each other based on the basis of weight, thickness and the like. Due the differences, to form a high-quality image, it is desired to set fixing conditions in detail based on the type and brand of the recording medium such as the recording sheet.

Such recording media include plain paper, coated sheets such as a gloss coated sheet, a matt coated sheet, an art coated sheet, an OHP sheet, a special sheet having an embossed surface and the like. The number of the types and brands of the recording media is increasing. In the above examples, recording sheets are described as the examples of the recording media. However, it is noted that there are recording media which are other than the recording sheets.

On the other hand, even the latest image forming apparatus, the fixing condition of the image forming apparatus may be desired to be set by a user. Due to this, the user may have to have a knowledge of the various types of the recording media or the like. Further, the fixing condition may have to be set by the user, the user may feel uncomfortable because it is required to set the fixing condition by himself/herself. Further, if the fixing condition is not set correctly, a desired high-quality image may not be acquired.

To overcome the problem, research has been made to provide a sensor capable of identifying the type of a recording medium such as a recording sheet by automatically sensing the type of the recording medium such as the recording sheet and an image forming apparatus including such a sensor so as to automatically sense the type of the recording medium and is capable of forming an image.

For such a sensor for identifying (sensing) the type of a recording medium such as a recording sheet, there is a method, as described in Patent Document 1, in which a sensing probe is used to detect a surface friction resistance, and there is another method, as described in Patent Document 2, in which a pressure sensor or the like is used to detect the strength (stiffness) of the recording sheet. Further, as described in Patent Document 3, as a non-contact method of identifying the type of the recording medium, an imaging device such as an area sensor is used to capture an image of a surface of the recording medium to identify the type or the like of the recording medium based on the captured image.

Further, as a non-contact method of identifying the type or the like of the recording medium, there is a method using reflected light. In the method of using the reflected light, the light emitted from a light source such as a Light Emitting Diode (LED) is irradiated to the recording medium to be identified, and the type or the like of the recording medium is identified based on a reflected light amount from the recording medium. As the method of using the reflected light, there are three methods as described below.

In the first method, as described in Patent Document 4, the light amount of the reflected light is detected in the regular reflection direction of the light which is irradiated on the surface of the recording media to identify the brand or the like of the recording medium based on the detected light amount of the reflected light in the regular reflection direction. More specifically, in Patent Document 4, the brand of the recoding medium is identified by detecting the light amount in the regular reflection direction and the light amount of the light having passed through the recording sheet. Therefore, accurately speaking, the recording sheet is not identified based on the light amount in the regular reflection direction alone.

In the second method, as described in Patent Document 5, a plurality of light amount detecting units are used to detect not only the light amounts of the reflected light of the light irradiated on the surface of the recording medium in the regular reflection direction but also the light amounts of the scattered reflected light, so that the brand or the like of the recording medium is identified based on the detected light amount in the regular reflection direction and the light amount of the scattered reflected light.

In the third method, as described in Patent Document 6, the reflected light of the light irradiated on the surface of the recording medium in the regular reflection direction is divided by a polarization beam splitter to measure the light amount of the divided light, so that the brand or the like of the recording medium is identified based on the measured light amount.

Further, as a method of foreign matte inspection or the like, Patent Documents 7 and 8 disclose the inspection device and the inspection method.

SUMMARY OF THE INVENTION

Problems to be Solved by the Invention

However, the methods described in Patent Documents 1 and 2 are contact methods. Therefore, the surface of the recording sheet of the recording medium may be damaged. Further, when the method described in Patent Document 3 is used, the smoothness and the like of the recording medium may be detected. However, it is difficult to detect the thickness and the like of the recording medium. Further, when the method described in any of Patent Documents 4 through 6 is used, it may be possible to roughly determine the type or the like of the recording medium. However, the determination result may not be less accurate than in the determination that is made in detail based on an air leak test or the like.

Further, in addition to the above methods, there may be a method in which an image forming apparatus includes a sensor or the like using ultrasonic waves or the like to identify the recording medium in more detail. However, in this method, a plurality of sensors using different methods may have to be included in the image forming apparatus. As a result, the size and the cost of the image forming apparatus may be increased to generate a new problem.

The present invention is made in light of the above problems, and may provide a compact optical sensor capable of identifying the recording medium at a lower cost, and accordingly an image forming apparatus capable of forming a high-quality image without increasing the size of the apparatus with lower cost by having such a compact optical sensor.

Means for Solving the Problems

According to an aspect of the present invention, an optical sensor includes a light source; and an optical detector detecting intensity of light that is reflected by a recording medium, the light emitted from the light source and irradiated onto the recording medium. Further, when an incident angle of the light incident to the recording medium from the light source relative to a normal line of the recording medium is given as $\theta 1$, a formula $75° \leq \theta 1 \leq 85°$ is satisfied.

According to another aspect of the present invention, an optical sensor includes a light source; and an optical detector detecting intensity of light that is reflected by a recording medium, the light emitted from the light source and irradiated onto the recording medium. Further, when an incident angle of the light incident to the recording medium from the light source relative to a normal line of the recording medium is given as $\theta 1$, and a detection angle of light that is incident to the optical detector relative to the normal line of the recording medium is given as $\theta 2$, the light source and the optical detector are arranged so that a formula $\theta 1 > \theta 2$ is satisfied.

According to another aspect of the present invention, an optical sensor includes a light source; an aperture through which light from the light source passes; and an optical detector detecting intensity of light that is reflected by a recording medium, the light emitted from the light source and irradiated onto the recording medium. Further, the light from the light source is scattered in the aperture, and the scattered light is incident into the optical detector.

Effects of the Present Invention

According to an aspect of the present invention, it may become possible to provide a compact optical sensor capable of identifying a recording medium in detail at lower cost, and an image forming apparatus capable of forming a high-quality image without increasing the size of the apparatus at a lower cost.

BRIEF DESCRIPTION OF THE DRAWINGS

FIG. 6 is a graph showing relationships between smoothness and process conditions;

FIG. 20 shows a relationship between regular reflection light and scattered reflection light;

FIG. 26 shows a sheet type ranking list;

BEST MODE FOR CARRYING OUT THE INVENTION

Figure 1:
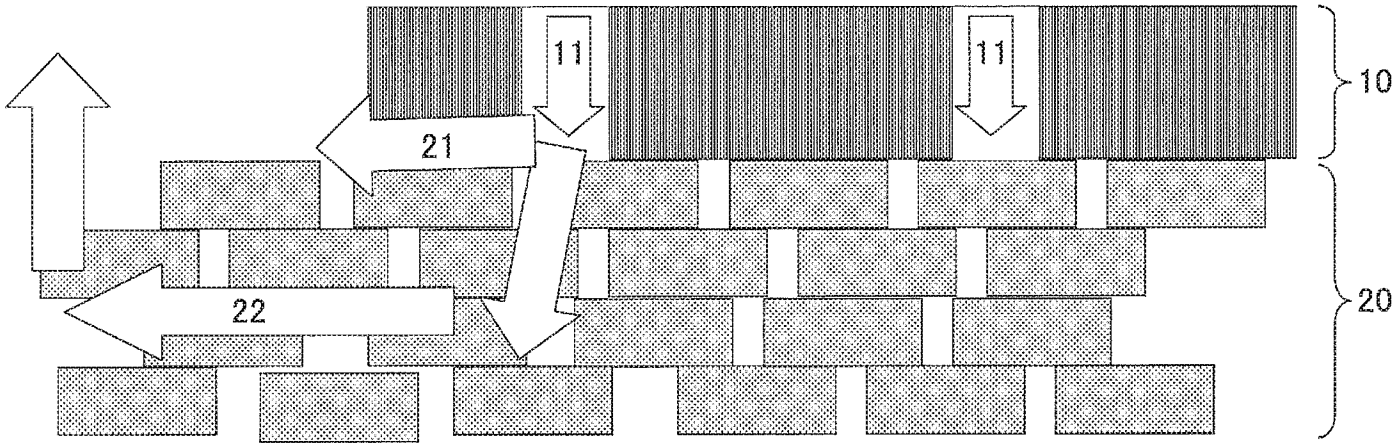
FIG. 1 schematically shows an air leak test.

Embodiments to carry out the present invention are described below. Throughout the embodiment, the same reference numerals are used to describe the same elements or the like, and the repeated descriptions thereof may be omitted.

First Embodiment

On the other hand, it is possible to observe (measure) the state (status) of a surface of the recording sheet by using a confocal microscope or the like. However, it is known that the asperity slopes formed on the surface of the recording sheet are steep. Therefore, the measurement results may include considerable noise components, and it may take a long time to measure the state of the surface. To overcome the problem, in the paper industry and the like, a result of an air leak test is typically used to evaluate (measure) the smoothness of the paper as an index of the surface status (smoothness) of the paper such as the recording sheet. This is because the air leak test may be performed easily to measure the state of the surface. The index of the smoothness is typically used in the paper industry, so that, for example, the index is used as one of the references indicating the smoothness of the paper in developments of a copier and the like to optimize the printing conditions. Namely, as the index indicating the surface state of the paper, the result of the air leak test is more frequently used than a general index indicating the surface state using the root-mean-square height "Ra" or the like. However, although the air leak test may be performed easily, the size of the apparatus may be increased and it may take a certain amount of time as well. To overcome the problem, it is desired to provide an optical sensor that may be mounted in an image forming apparatus or the like to lower cost and may test the surface state (i.e., the smoothness) of a sheet similar to the air leak test.

Next, with reference to FIG. 1, the air leak test that is performed on a sheet is described. In the air leak test for testing the sheet, air 11 is supplied from a head 10 of an air leak apparatus to a recording sheet 20, so that the smoothness of the recording sheet 20 is measured based on a time period to leak the air 11. The air 11 supplied to the recording sheet 20 is separated into air 21 that leaks along the surface of the recording sheet 20 and air 22 that goes into the inside of the recording sheet 20 and leaks from the recording sheet 20. Due to air leak time period based on the air, the smoothness of the recording sheet 20 may be evaluated (measured).

Optical Sensor

Figure 2:
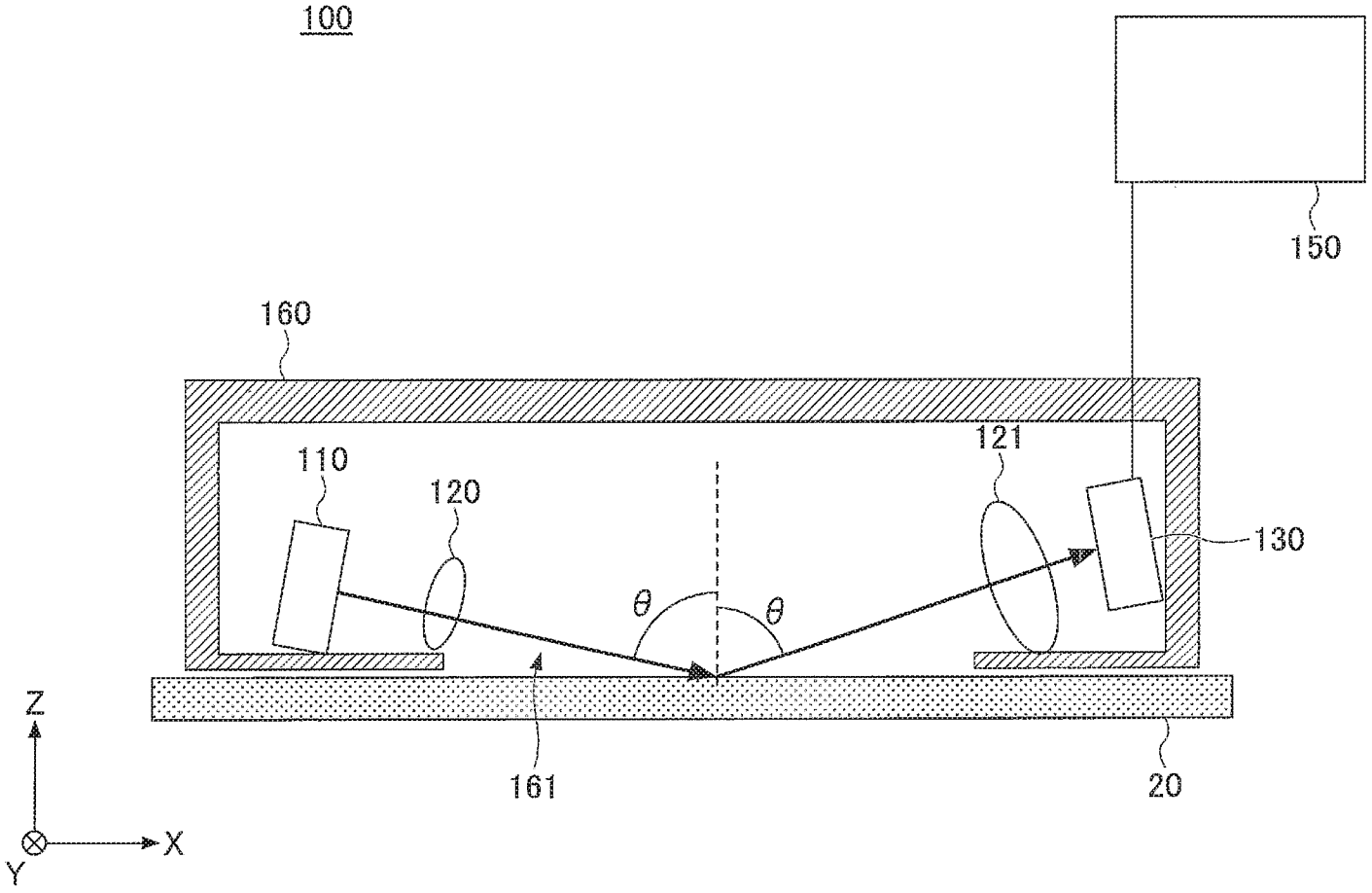
FIG. 2 shows a configuration of an optical sensor according to a first embodiment.

Next, an optical sensor according to this embodiment is described. FIG. 2 shows the optical sensor 100 according to this embodiment. The optical sensor 100 according to this embodiment includes a light source 110, a collimator lens 120 that collimates the light emitted from the light source 110, a regular reflection light detector 130 that includes a photo diode to detect the light that is regularly reflected by the recording sheet 20, and a lens 121 to incident the light having predetermined angles into the regular reflection light detector 130 so that the incident angle "θ" of the light incident to the recording sheet 20 is in a range from 75° (degrees) to 85° (degrees) (i.e., greater than or equal to 75° (degrees) and less than or equal to 85° (degrees)). Further, the regular reflection light detector 130 is connected to a controller 150, that performs control of the optical sensor, various calculations and the like. Further, the optical sensor in this embodiment further includes a chassis 160 having an opening on the bottom surface side thereof, and accommodates the light source 110, the collimator lens 120, the lens 121 and the like inside the chassis 160.

Light Source 110

In the optical sensor of this embodiment, a Light Emitted Diode (LED) may be used as the light source 110. As the LED, a chip-type LED having approximately 3 mm square may be used. Further, the LED used herein may emit infrared light having the emission wavelength of 850 nm. The infrared light is preferably used because of the higher sensitivity to be detected by optical sensors including the regular reflection light detector 130. The emitted light amount is determined based on the current value of the current introduced into the LED. The rated current herein is 20 mA and an electronic circuit (not shown) is used to control the current value to be the constant value. The LED serving as the light source 110 is directly fixed to the chassis 160 with ABS resin or the like.

In this embodiment, it is preferable that accurate collimated light be irradiated (incident) to the recording sheet 20. To that end, the collimator lens 120 is provided. As the collimator lens 120, a lens having, for example, a focal length f=9 mm and a diameter of 2 mmφ may be used. The collimator lens 120 is mounted (arranged) in a manner such that the focal position of the collimator lens 120 is disposed at the luminous (emission) point of the LED serving as the light source 110. The collimator lens 120 is fixed to the chassis 160 with a fixed margin having 0.5 mm size formed thereto. As described above, in this embodiment, a line between the luminous (emission) point of the LED serving as the light source 110 and the center of the collimator lens 120 is the optical axis. The LED serving as the light source 110 and the collimator lens 120 are disposed in a manner that the angle between the optical axis and the normal line of the recording sheet 20 is approximately 80° (degrees). Further, in this case, the collimator lens 120 is fixed to an appropriate position so that the collimator lens 120 and the like do not contact with the recording sheet 20 and the size of the chassis 160 is not too big.

Regular Reflection Light Detector 130

Similar to the light source 110, the regular reflection light detector 130 is also fixed inside the chassis 160. In this embodiment, as the reflection light detector 130, a photodiode (PD) is used. The PD to be used herein has approximately 3 mm square. Some PD includes a light detection surface, which becomes (serves as) a light receiving surface, having 1 mm square. As the lens 121 to incident the light into the PD which is the regular reflection light detector 130, a lens having, for example, a focal length (focal distance) f=9 mm and a diameter of 3 mmφ may be used. Further, the lens 121 is mounted (arranged) in a manner such that the focal position of the lens 121 is disposed at the light receiving surface of the PD which is the regular reflection light detector 130. By doing this, the incident angle width of the light incident to the regular reflection light detector 130 is approximately 5° (degrees). In this embodiment, the line between the center of the lens 121 and the center of the light receiving surface of the PD serving as the regular reflection light detector 130 becomes the optical axis. The regular reflection light detector 130 and the lens 121 are arranged (disposed) so that the angle between the optical axis and the normal line of the recording sheet 20 is (approximately) 80° (degrees). To that end, the lens 121 and the PD which becomes the regular reflection light detector 130 are obliquely arranged with respect to the recording sheet 20.

Position of Recording Sheet 20

The object to be detected by the optical sensor in this embodiment is the recording sheet 20. In the description of this embodiment, the target of the optical sensor is the recording sheet 20. However, it should be noted that the optical sensor may also detect another recording medium other than the recording sheet 20, and the recording sheet 20 is described herein as an example of the object to be detected by the optical sensor. For example, the recording sheet 20 is fed by a feeding roller (not shown) along the guide. Therefore, the distance between the optical sensor in this embodiment and the recording sheet 20 is controlled so that the distance is always constant. Here, the position where the optical axis of the regular reflection light detector 130 crosses the optical axis of the light source 110 is called a "focal position". The focal position is arranged to be formed at the position located approximately 500 μm, which is inside of the chassis 160, from the surface formed by the bottom surface of the chassis 160. Therefore, the position of the recording sheet 20, which is fed along the bottom surface of the chassis 160, is separated from the "focal position" by 500 μm.

Chassis 160

As described above, the optical sensor in this embodiment includes the light source 110, the collimator lens 120, the regular reflection light detector 130, the lens 121 and the like, which are accommodated in the chassis 160. Further, light is irradiated to the recording sheet 20 through the opening 161 of the chassis 160, so that the regular reflection light, which is the reflection of the irradiated light, from the recording sheet 20 is received by the regular reflection light detector 130. The chassis 160 is formed of ABS resin having a black color so as to absorb light, so that disturbance light may be eliminated. The chassis 160 is formed (provided) so that the light source 110, the collimator lens 120, the regular reflection light detector 130, the lens 121 and the like are fixed and mounted inside the chassis 160. Although the size of the chassis 160 may be determined based on the sizes of the collimator lens 120 and the lens 121, the chassis 160 may be formed to have sizes approximately 50 mm, 10 mm, and 6 mm in x, y, and z directions, respectively.

Controller

Figure 3:
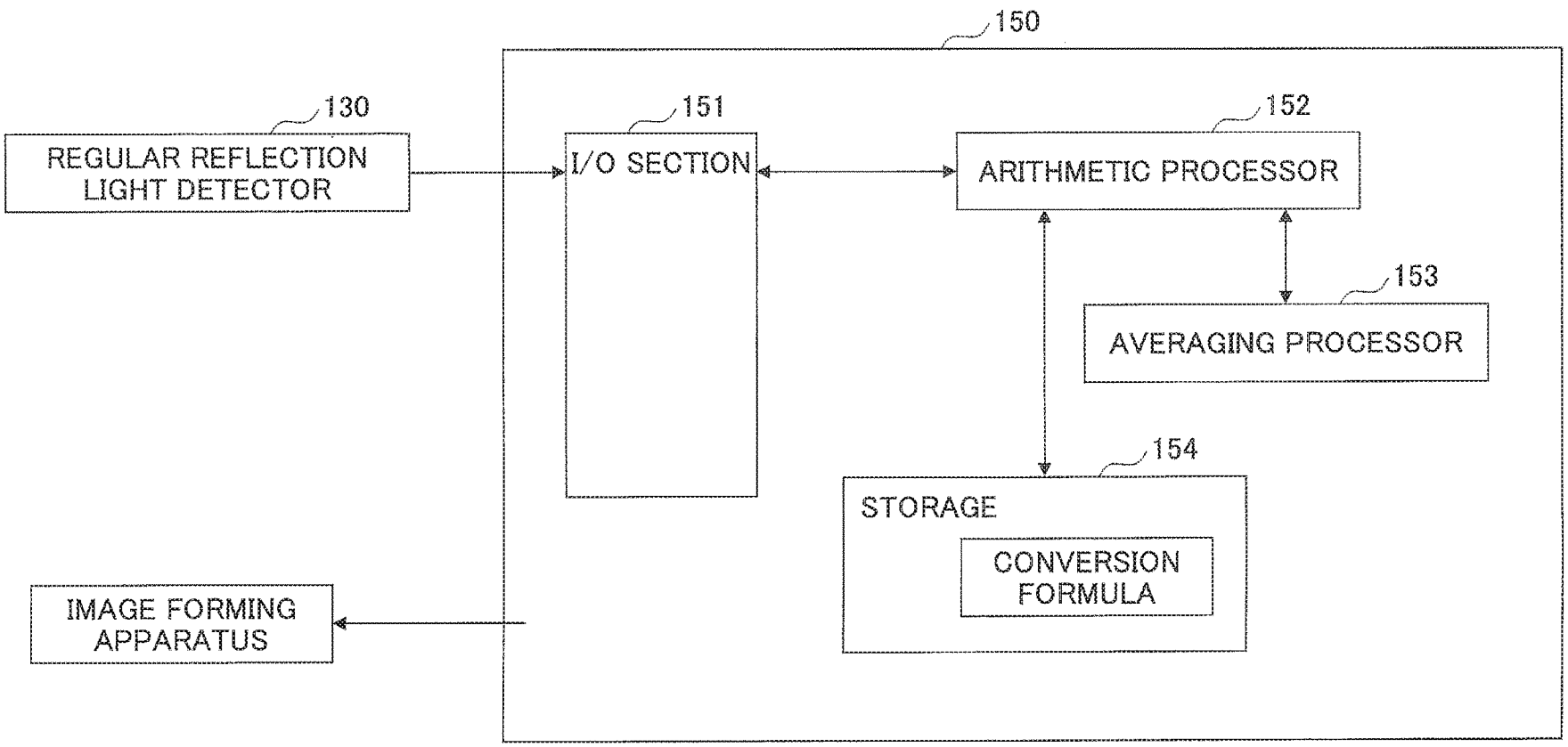
FIG. 3 shows a configuration of a processing section of the optical sensor according to the first embodiment.

Next, the controller 150 of the optical sensor in this embodiment is described. As shown in FIG. 3, the controller 150 is connected to the regular reflection light detector 130 and the like, and includes an I/O section 151 that performs input/output control on signals from the regular reflection light detector 130 and the like, an arithmetic processor 152 that performs various calculations such as signal processing, an averaging processor 153 that performs an averaging process, and a storage 154 that stores various information. Further, the optical sensor in this embodiment is connected to the image forming apparatus via the controller 150. Further, in the description of this embodiment, although the controller 150 is included in the optical sensor, if the optical sensor in this embodiment is included (mounted) inside the image forming apparatus, the controller 150 may be mounted inside the image forming apparatus and may perform, for example, control on the optical sensor in this embodiment.

Detection Method Using Optical Sensor and the Like

Figure 4:
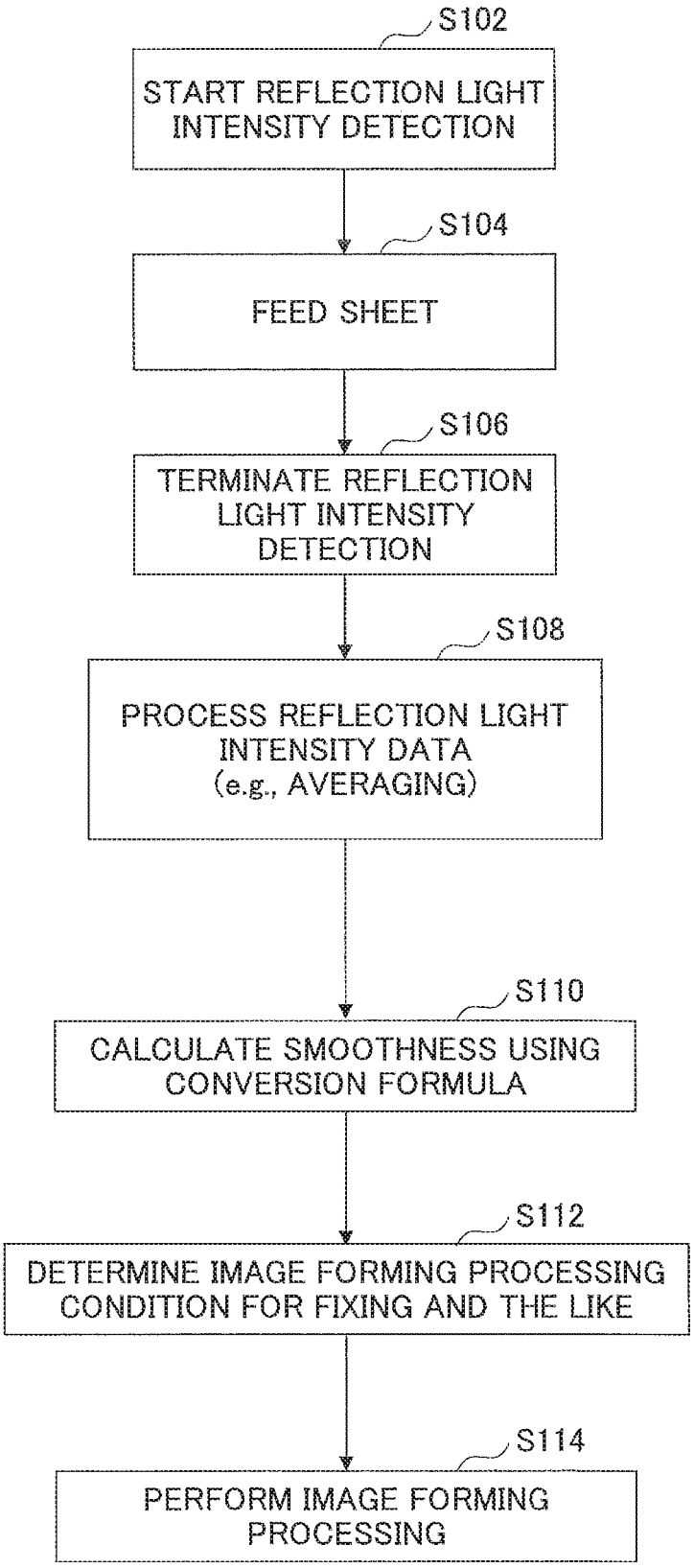
FIG. 4 is a flowchart of a detecting method using the optical sensor according to the first embodiment.

Next, a detection method and the like using the optical sensor according to this embodiment is described with reference to FIG. 4.

First, as shown in step S102, a reflected light intensity detecting operation using the optical sensor according to this embodiment is started. Specifically, the reflected light intensity detecting operation using the optical sensor according to this embodiment is started by turning on the power, or transmitting a signal indicating the start of printing to the image forming apparatus connected to the optical sensor in this embodiment.

Figure 5:
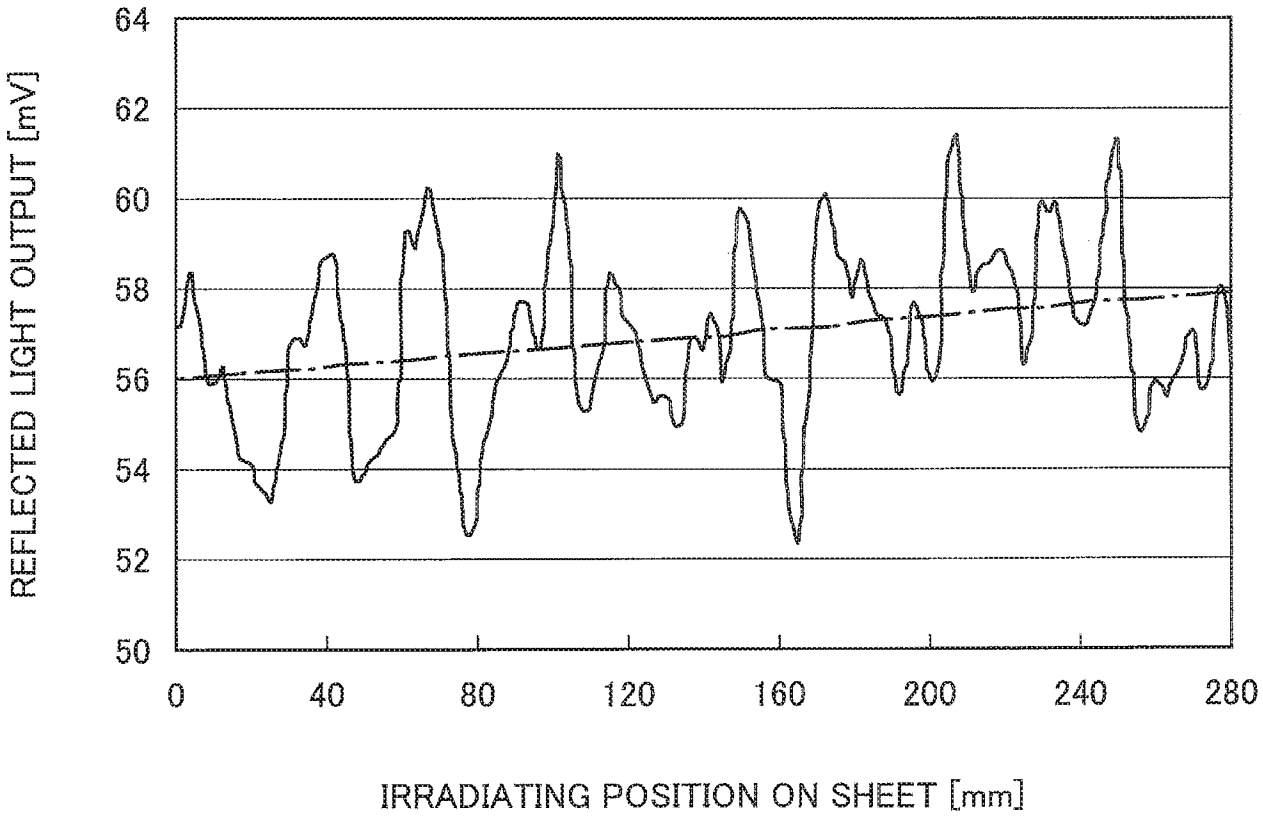
FIG. 5 is a graph showing a distribution of regular reflection direction light intensity on a surface of a recording sheet.

Next, as shown in step S104, the recording sheet 20 is fed. By feeding the recording sheet 20 in this way, the light emitted from the light source 110 is irradiated onto the fed recording sheet 20 via the collimator lens 120, and the regular reflection light from the recording sheet 20 is incident into the regular reflection light detector 130. Further, while the recording sheet 20 is being fed, the light is irradiated onto the recording sheet 20 and the regular reflection light on the recording sheet 20 is detected. By doing this, the regular reflection light from one end to the other end of the recording sheet 20 may be detected. Specifically, as shown in FIG. 5, regular reflection light amounts corresponding to the positions where the light is irradiated onto the recording sheet 20 may be measured. The regular reflection light amounts may be effectively (advantageously) used to specify (identify) the type (kind) of the recording sheet if the type of the recording sheet has its specific pattern or the like.

Next, as shown in step S106, the detection (measurement) of the regular reflection light on the recording sheet 20 is terminated, and the measurement result is transmitted to the controller 150.

Next, as shown in step S108, in the controller 150, an averaging process is performed on the (reflected) light intensity which is detected by the regular reflection light detector 130. The averaging process is performed by the averaging processor 153 of the controller 150.

Next, as shown in step S110, in the controller 150, smoothness is calculated based on the light intensity on which the averaging process is performed by the averaging processor 153. Specifically, in the arithmetic processor 152 of the controller 150, the smoothness is calculated based on the light intensity using a predetermined conversion formula stored in the storage 154 of the controller 150. For example, when the light intensity of the regular reflection light detected by the regular reflection light detector 130 is given as X (mV), the smoothness Y (sec) may be calculated based on the conversion formula: $Y=0.46*X+19.8$.

Next, as shown in step S112, in the controller 150, based on the calculated smoothness, an image forming processing condition upon fixing in printing an image on the recording sheet 20 in the image forming apparatus is determined. Specifically, based on the relationship between the smoothness and the processing condition stored in the storage 154 of the controller 150, the condition closest to the calculated smoothness is determined as the image forming processing condition upon fixing.

Next, as shown in step S114, in the image forming apparatus, the printing is performed on the recording sheet 20, so that the image is formed on the recording sheet 20.

By doing this, the smoothness may be detected by using the optical sensor in this embodiment, and based on the detected smoothness, it may become possible to set a corresponding printing condition in the image forming apparatus.

Next, the optical sensor in this embodiment is described specifically in more detail.

Optical Sensor 1

Figure 7:
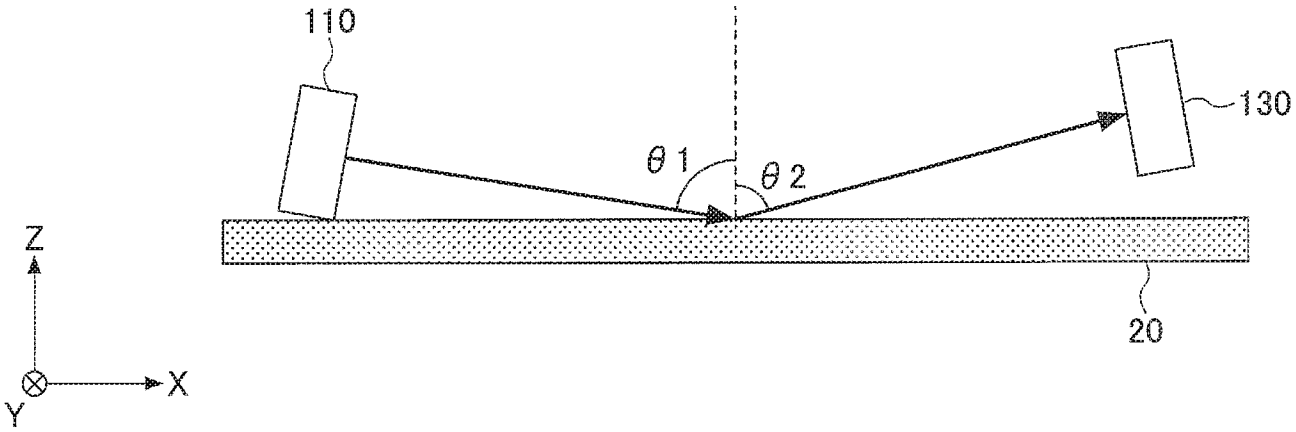
FIG. 7 shows a configuration of an optical sensor 1 according to the first embodiment.

An experiment is conducted to determine an optimal incident angle to detect the smoothness of the recording sheet 20. As shown in FIG. 7, the light source 110, the regular reflection light detector 130, and the recording sheet 20 are arranged so that the light emitted from the light source 110 is reflected by the recording sheet 20, and the regular reflection light is incident into the regular reflection light detector 130. Here, it is assumed that the angle between the optical axis of the light from the light source and incident to the recording sheet and the normal line of the sheet surface of the recording sheet 20 is given as "θ1", and the angle between the optical axis of the light reflected by the recording sheet 20 and incident to the regular reflection light detector 130 and the normal line of the sheet surface of the recording sheet 20 is given as "θ2". Further, the light source 110, the regular reflection light detector 130, and the recording sheet 20 are arranged so that the angle "θ1" ("incident angle") is equal to the angle "θ2" ("detection angle").

Next, the incident angle "θ1" and the detection angle "θ2" are changed from 60° (degrees) to 90° (degrees). In this case, the light source 110 and the regular reflection light detector 130 are moved simultaneously so that the incident angle "θ1" is equal to the detection angle "θ2". For the measurement, a highly-accurate photogoniometer is used. As the light source 110, a laser diode (LD) is used. The collimator lens (not shown in FIG. 7) is used to form parallel light having a beam diameter of approximately 1 mm. As the regular reflection light detector 130, a photo diode (PD) approximately 2 mm square is used. The light to be incident to the PD, which is the regular reflection light detector 130, is incident to the PD via the lens (not shown in FIG. 7). The experiment is conducted by setting the incident angle width of the light incident to the regular reflection light detector 130 to be approximately 0.5° (degrees) and changing the incident angle "θ1" and the detection angle "θ2" by 0.1° (degree) steps. The emission intensity is set to be a constant value by setting the value of the current supplied to the PD to be constant. In the PD, the light amount corresponding to the incident light is converted into a current value, and the current value is further converted into a voltage value by an operational amplifier. By reading the voltage value, the light amount of the light incident to the PD, which is the regular reflection light detector 130, is detected.

Figure 8:
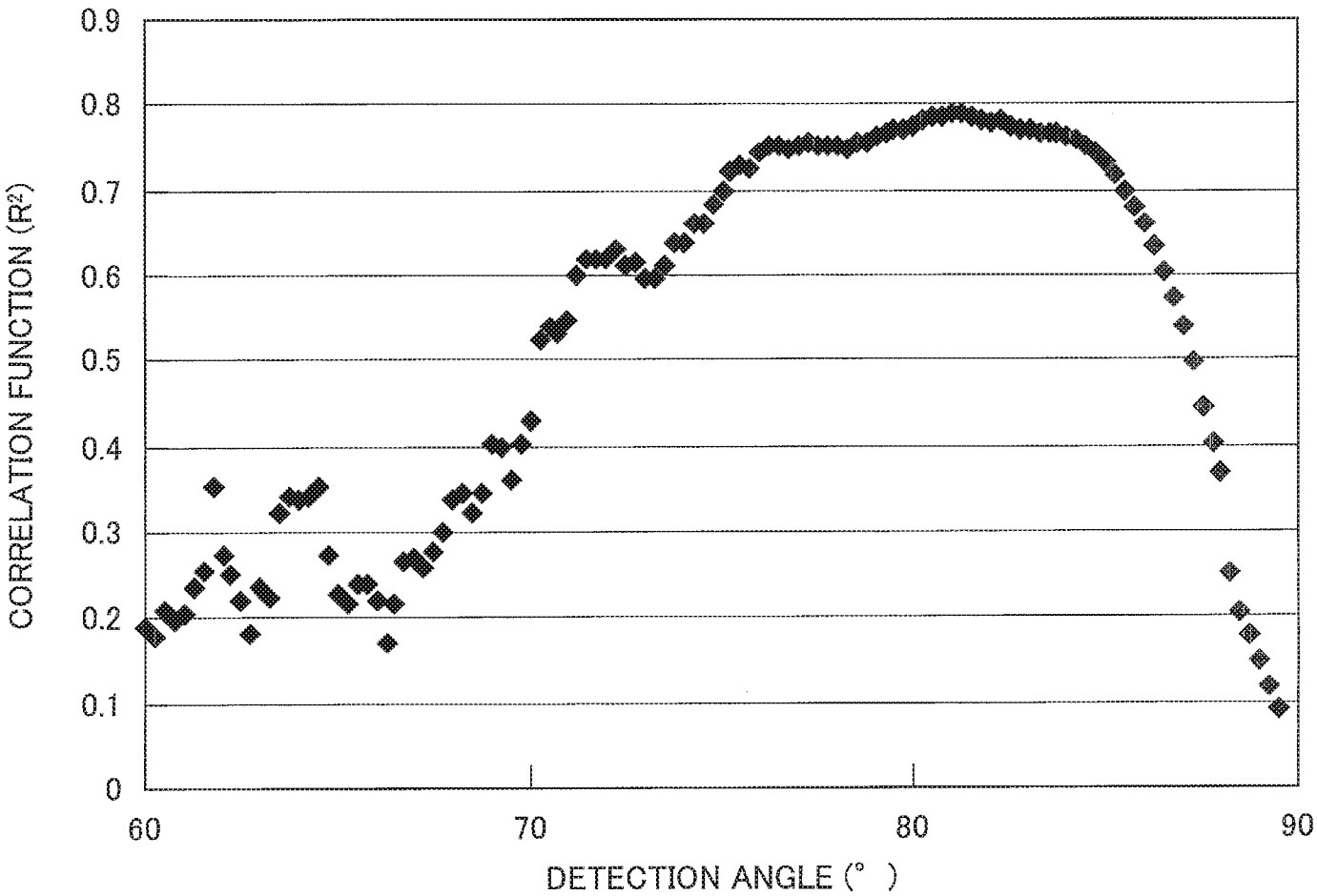
FIG. 8 is a correlation diagram between a detection angle and a correlation coefficient of the optical sensor 1.

In the experiment, as the recording sheet 20, thirty types of plain paper are selected. The select thirty types of plain paper are substantially the same as those available in the market. The smoothness of the thirty types of plain paper are measured in advance by using a smoothness measurement apparatus. It is assumed that the region where the smoothness of the plain paper is measured by the smoothness measurement apparatus is substantially the same as the region where the smoothness is measured by the photogoniometer. FIG. 8 shows a relationship between the angle of the incident angle "θ1" and the detection angle "θ2" and the correlation coefficient. Further, in FIG. 8, the horizontal axis denotes the angle on behalf of the incident angle "θ1" and the detection angle "θ2".

As shown in FIG. 8, when the incident angle "θ1" and the detection angle "θ2" are approximately 80° (degrees), the correlation coefficient has its peak, and the correlation coefficient value at the peak is approximately 0.8. On the other hand, when the incident angle "θ1" and the detection angle "θ2" are 85° (degrees) or 75° (degrees) which is different by 5° (degrees) from 80° (degrees), the correlation coefficient value is approximately 0.7. When the correlation coefficient value is less than 0.7, it may not be sufficient for the smoothness measurement of the recording sheet. Namely, to perform the control of the copier based on the correlation coefficient value, it is desired that the correlation coefficient value is greater than or equal to 0.7. Therefore, when the optical sensor in this embodiment is used as the smoothness sensor of the recording sheet, it is desired that the incident angle "θ1" and the detection angle "θ2" is in a range of 80±5° (degrees) (i.e., 75° (degrees)≤θ1≤85° (degrees)). Further, the above-described correlation coefficient value is calculated based on the following formula 1. Further, the incident angle "θ1" and the detection angle "θ2" denotes the angle relative to the normal line of the of the sheet surface of the recording sheet 20.

$$\frac{\sum_{i=1}^{n}(x_i-\bar{x})(y_i-\bar{y})}{\sqrt{\sum_{i=1}^{n}(x_i-\bar{x})^2}\sqrt{\sum_{i=1}^{n}(y_i-\bar{y})^2}}$$

$x_i$: smoothness of i-th sheet type
$y_i$: sensor output of i-th sheet type
$\bar{x}$: smoothness average value of 30 sheet types
$\bar{y}$: sensor output average value of 30 sheet types
n: 30 (sheet types)
i: integer (1-30)

As described above, by setting the incident angle "θ1" to be 75° (degrees)≤θ1≤85° (degrees), it may become possible to improve the correlation coefficient relative to the smoothness of the recording sheet. Accordingly, it may become possible to improve the detection accuracy of the type of the recording sheet.

Optical Sensor 2

Figure 9:
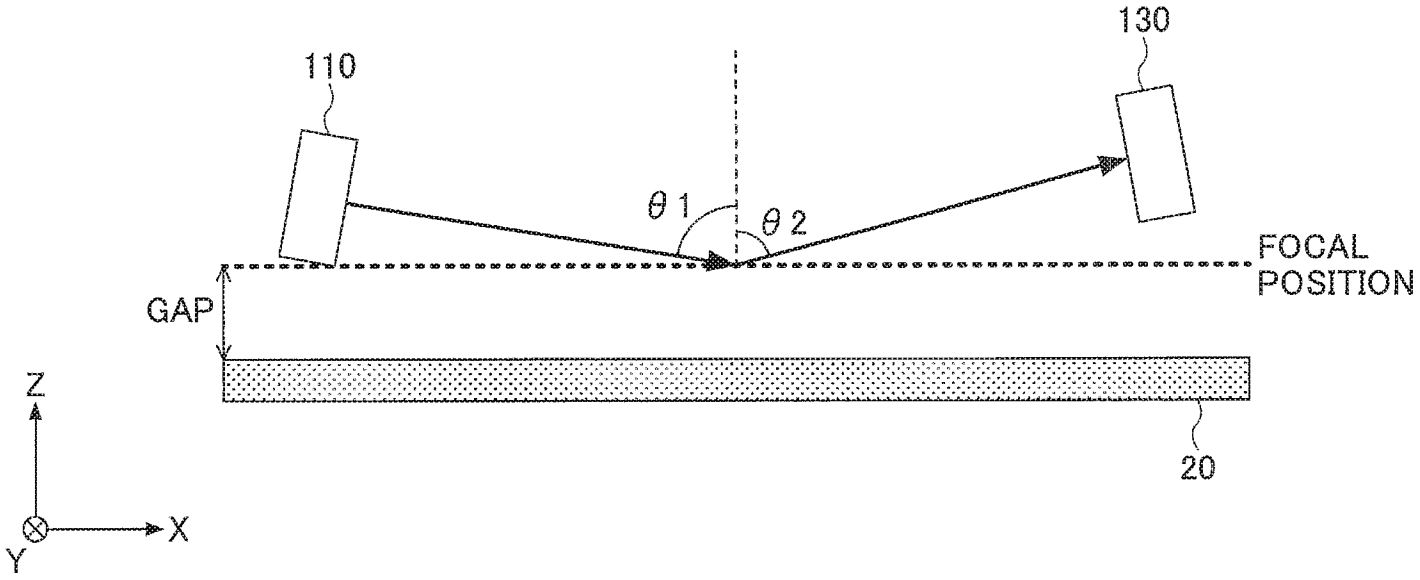
FIG. 9 shows a gap (distance) between the recording sheet and the optical sensor.

On the other hand, as shown in FIG. 9, in a case where the optical sensor is formed so that the incident angle "θ1" and the detection angle "θ2" are relatively shallow (e.g., 80°), if the distance between the recording sheet 20 and the optical sensor is shifted from the predetermined distance, the detection accuracy may be reduced. The distance ("gap") between the recording sheet 20 and the focal position in the optical sensor may vary by several mm due to positional displacement of the recording sheet while being fed. Therefore, it may be desired that the optical sensor has stability against the positional fluctuation and the like of the recoding sheet 20 while the recording sheet 20 is being fed.

Figure 10:
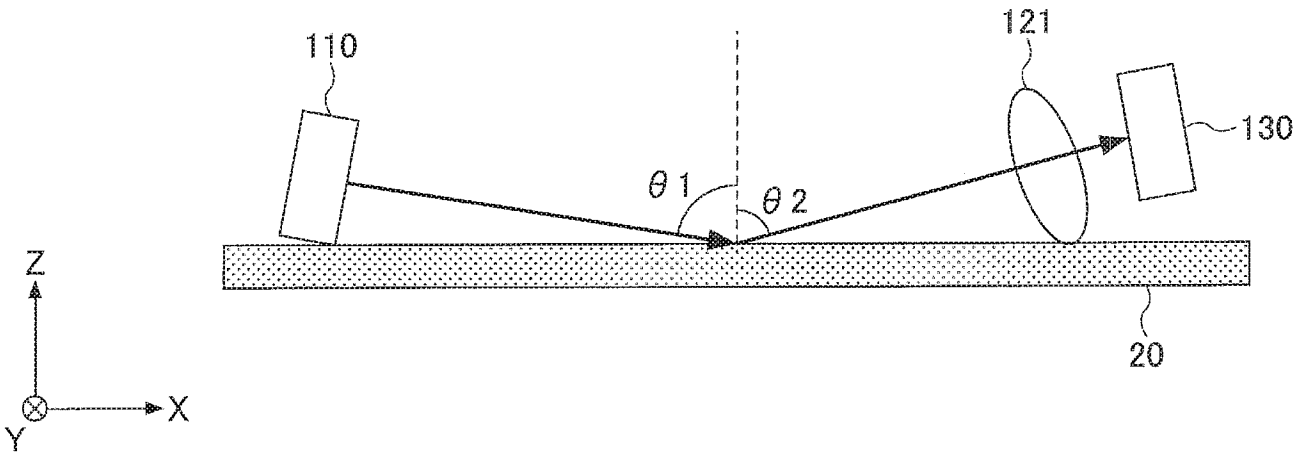
FIG. 10 shows a configuration of an optical sensor 2 according to the first embodiment.

Such an optical sensor may be achieved by providing the lens 121 between the recording sheet 20 and the regular reflection light detector 130 as shown in FIG. 10.

By providing the lens 121 between the recording sheet 20 and the regular reflection light detector 130, the light incident within the aperture of the lens 121 may be converged to the PD which is the regular reflection light detector 130. Namely, not only the light incident to the center part of the lens 121 but also the light incident in parallel within the effective aperture of the lens may be converged. Namely, by using the lens 121, the displacement of the incident position of the incident light within the effective aperture of the lens 121 may become allowable.

Such effects are described based on an experiment. As the light source 110, the LED is used. Further, the collimator lens (not shown in FIG. 10) is used to parallelize the light from the light source 110, so that the parallelized light is irradiated to the recording sheet 20. Among the light irradiated to the recording sheet 20, the light reflected by the recording sheet 20 is incident to the regular reflection light detector 130. Here, the lens 121 having the focal length f=9 mm and the diameter of 3 mmφ is disposed between the recording sheet. In this case, the lens 121 is disposed so that the receiving light surface of the regular reflection light detector 130 is disposed at the focal position of the lens 121.

In this experiment, four lenses 121 having the same NA and different lens diameters from each other are separately used in the optical sensor. Then, while the gap is changed, the light intensity is measured. As the gap is gradually increased, the light amount is gradually decreased. This is because the distance from the recording sheet 20 serving as the reflection surface is increased. As a result, the light amount of the reflected light from the recording sheet 20 is decreased.

Figure 11:
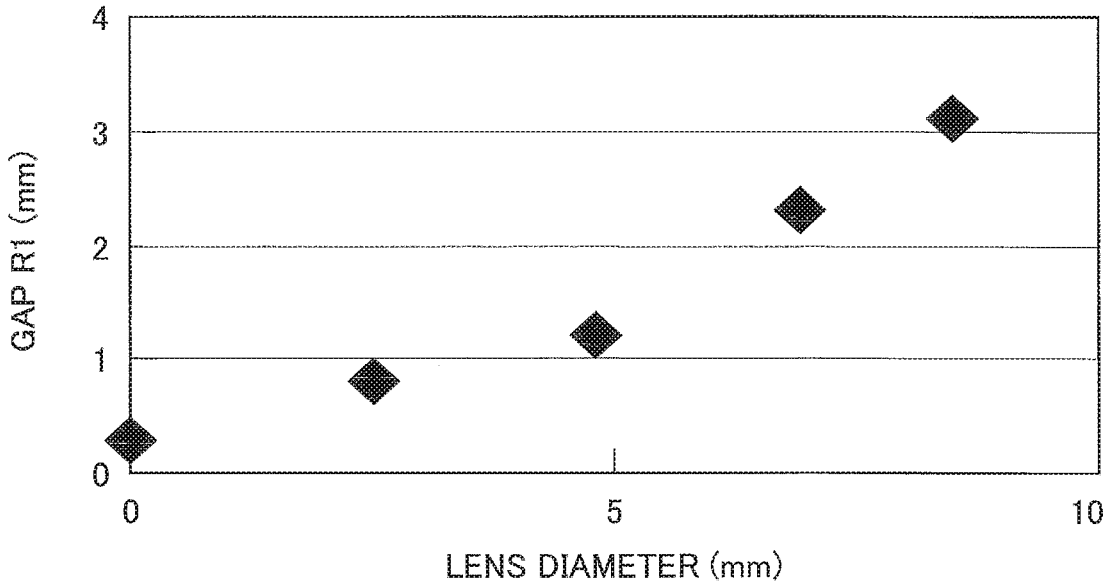
FIG. 11 is a correlation diagram between a lens diameter in the optical sensor 2 and a gap R1.

Here, the gap position where the ratio of the light amount at the gap position to the light amount at the focal position is 90% is called a "gap R1". The gap R1 varies depending on the size (diameter) of the lens. Specifically, as shown in FIG. 11, there exists a correlative relationship between the lens diameter and the gap R1. Namely, the greater the lens diameter is, the greater the gap R1 is. For comparison purposes, data of the gap R1 when no lens 121 is provided is plotted at lens diameter (radium) is 0 mm. As shown in FIG. 11, when no lens 121 is disposed, the gap R1 is less than 1 mm. On the other hand, when the lens 121 having the lens diameter of 5 mm, the gap R1 exceeds 1 mm. Therefore, by providing the lens 121 between the recording sheet 20 and the regular reflection light detector 130, it may become possible to acquire an optical sensor that is unlikely to be influenced by the gap fluctuation.

Optical Sensor 3

Further, in the relationship between the incident angle "θ1" and the detection angle "θ2", by setting θ1<θ2, it may become possible to improve the detection accuracy of the smoothness. In the following, an experiment showing the improvement is described.

Figure 12:
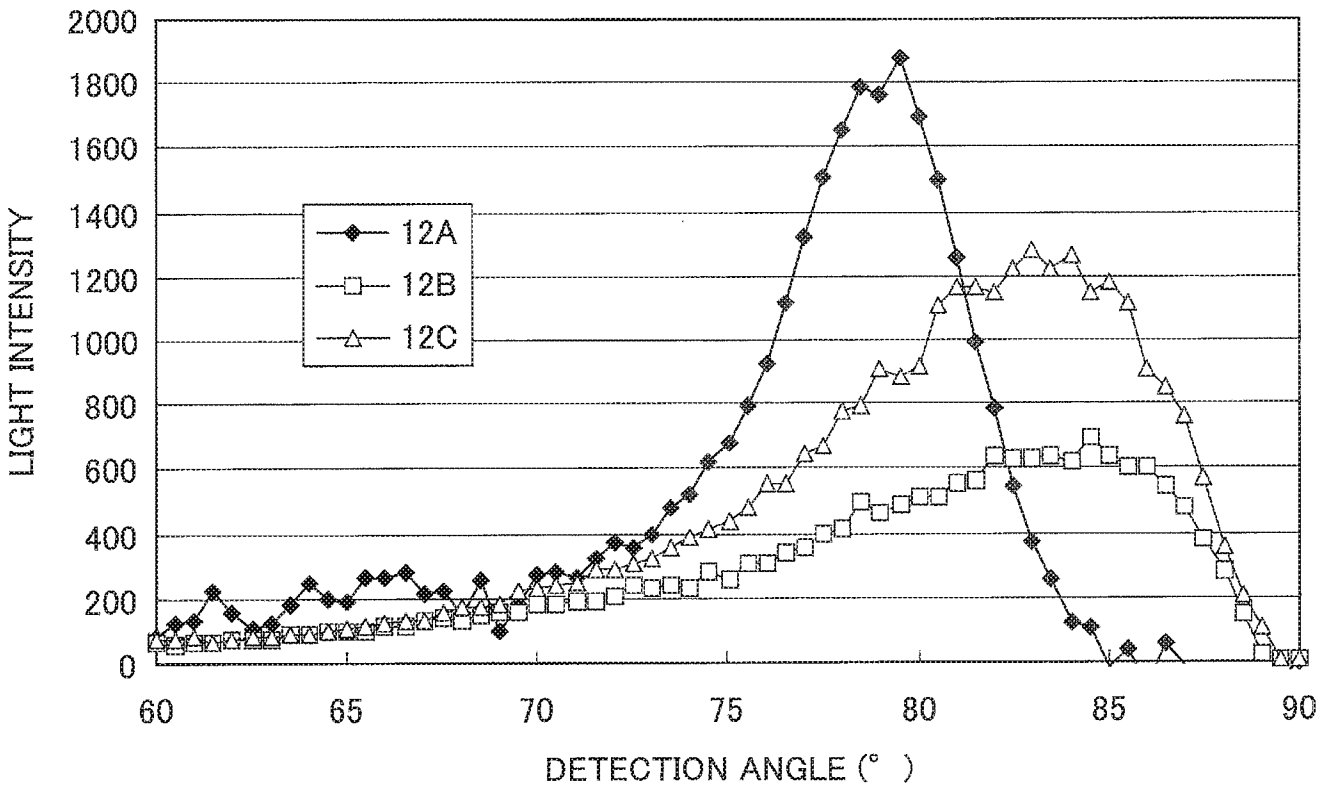
FIG. 12 is a correlation diagram between the detection angle and a detected light amount of an optical sensor 3.

A case is described where the detection angle θ2 is changed while the incident angle θ1 is fixed and the optical sensor of FIG. 7 is used, and FIG. 12 shows the light amount detected by the regular reflection light detector 130. In FIG. 12, the line 12A denotes the data of a coated sheet, and lines 12B and 12C denotes the respective data of plain paper. The smoothness of the coated sheet in line 12A is 5200 sec, and the smoothness values of the plain paper in lines 12B and 12C are 40 sec and 120 sec, respectively. As may be apparent from the angle dependency characteristics, the peak of the light intensity is detected at approximately 80° (degrees) in the coated sheet in line 12A. On the other hand, the peak of the light intensity is detected at a degree greater than 80° (degrees) by approximately 5° (degrees) in the plain paper in lines 12B and 12C.

Generally, it is supposed that the intensity of the reflected light amount is related to the smoothness of the recording sheet. Actually, when the detection angle θ2 at the angle of regular reflection is 80° (degrees), the relationship may be observed. However, when the detection angle θ2 becomes 85° (degrees), the relationship is hardly observed. Namely, when the detection angle θ2 is 85° (degrees), the reflection light amount of the coated sheet in line 12A is greatly reduced, but the reflection light amounts of the plain paper in lines 12B and 12C are increased. Therefore, the relationships between the coated sheet and the plain paper at 85° (degrees) are opposite to each other. Accordingly, the relationship with the sheet smoothness may be impaired. This is because the angle of the intensity peak position of the plain paper is shifted to the higher angle side from the angle where the regular reflection is observed by 5° (degrees).

Figure 13:
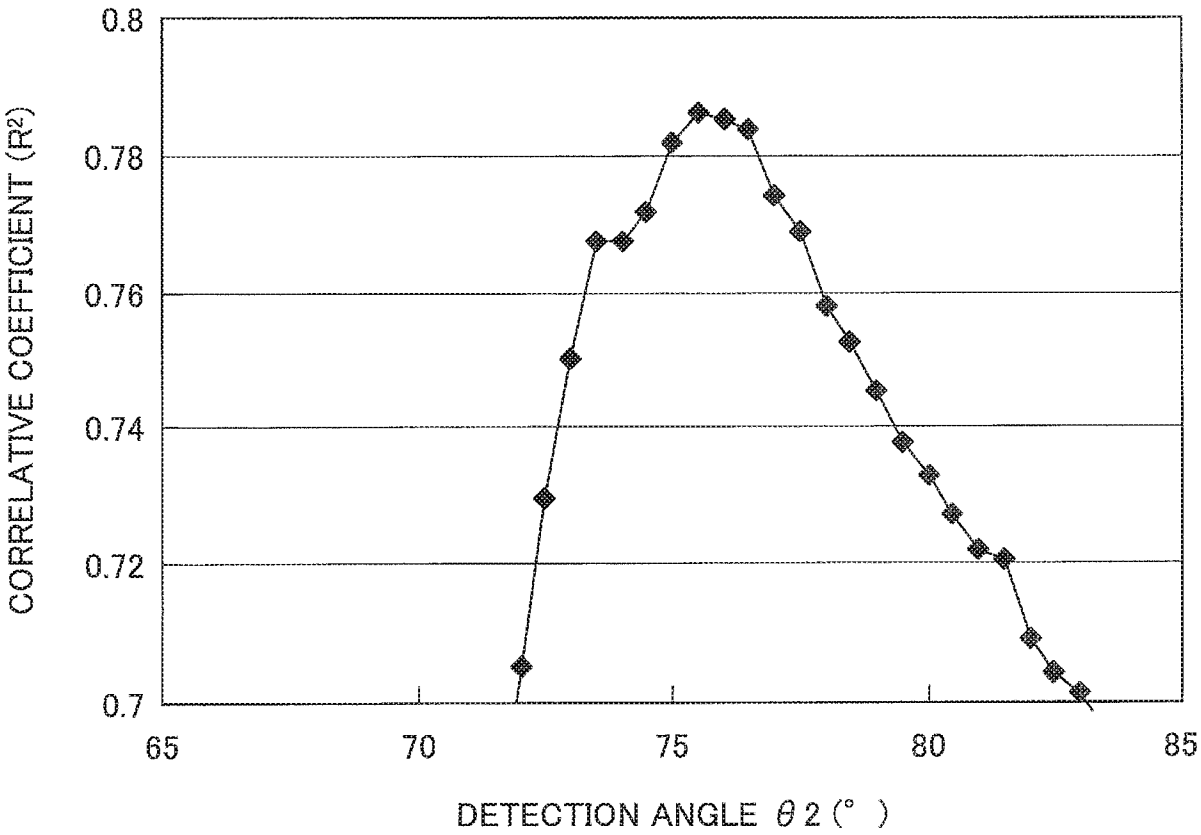
FIG. 13 is a correlation diagram between the detection angle and a correlation efficient of the optical sensor 3.

FIG. 13 shows the relationship between the correlation coefficient ($R^2$), which is related to the smoothness, and the detection angle "θ2". The relationship is acquired by measuring the smoothness of seventeen types of sheets and by measuring the reflection intensity angle dependency at the incident angle of 80° (degrees) by using the optical sensor of FIG. 7. Although the results may vary depending on the incident angle width of the light incident to the regular reflection light detector 130, when the incident angle width is 5° (degrees) which is relatively small, the detection angle "θ2" having the greatest correlation coefficient is 76° (degrees). Further, the correlation coefficient at the detection angle "θ2" 71° (degrees) is substantially the same as that at the detection angle "θ2" 83° (degrees). Therefore, it is desired that the shift amount from the angle where the regular reflection starts is within approximately 10° (degrees).

Optical Sensor 4

Figure 14:
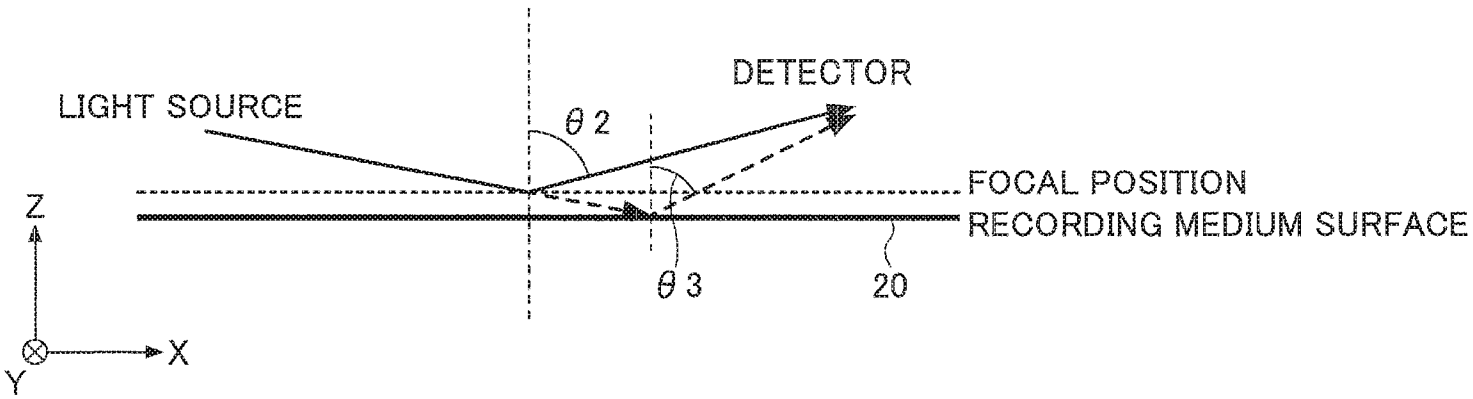
FIG. 14 shows a relationship between a focal position and the position of the recording sheet.

Next, as shown in FIG. 14, the recording sheet 20 is set so that the surface of the recording sheet 20 is disposed to be separated from the focal position in the direction to be separated from the optical sensor side. By doing this, the angle "θ3" between the normal line of the recording sheet 20 and the regular reflection light detector 130 becomes less than the detection angle "θ2" relative to the regular reflection light detector 130 at the focal position (i.e., θ3<θ2). By doing this, the effect same as that of the optical sensor may be acquired. Specifically, to that end, the position where the light from the light source 110 is reflected by the recording sheet 20 is shifted to the regular reflection light detector 130 side when compared with the position on the focal point where the optical axis of the emitted light determined based on the light source 110, the collimator lens 120, and the aperture crosses the optical axis on the light receiving side determined based on the regular reflection light detector 130, the lens 121, and the aperture on the light receiving side.

Optical Sensor 5

Figure 15:
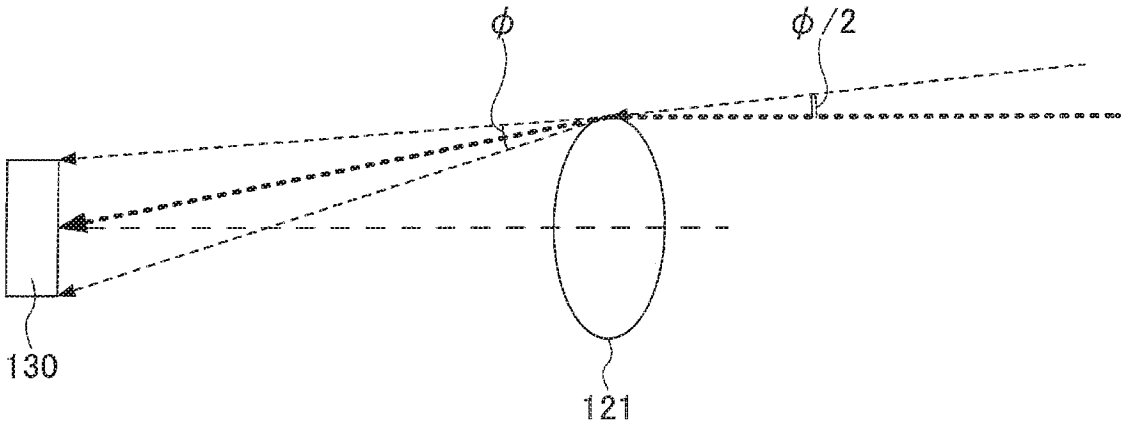
FIG. 15 shows a light incident angular width.

Further, the lens 121 has a function to converge parallel light to the regular reflection light detector 130. When the area of the regular reflection light detector 130 is ideally small, almost only parallel light may be converged. On the other hand, when the regular reflection light detector 130 has limited effective diameter, it may also become possible to converge the light which is slightly shifted from parallel light. Herein, the angle (of the light) shifted from the parallel light may be referred to as a "light incident angle". As schematically shown in FIG. 15, the light incident angle width herein is doubled due to the upper and lower sides, the angle "φ/2" in FIG. 15 is equal to a half value of the light incident angle width "φ". The light incident angle width "φ" depends on the area of the light receiving surface of the regular reflection light detector 130, and the f value of the lens 121. When the light incident angle width "φ" is large, the detection angle "θ2" is increased, and an error may occur. For example, as shown in FIG. 12, even when the detection angle "θ2" is 80° (degrees), if the light incident angle width "φ" exceeds 10° (degrees), the measurement value may be detected while the detection angle "θ2" exceeds the range from 75° (degrees) to 85° (degrees). As a result, the relationship relative to the smoothness may be impaired. Specifically, when the light incident angle width "φ" is 5° (degrees), the peak value of the correlation coefficient is approximately 0.79. Further, when the light incident angle width "φ" is 10° (degrees), the peak value of the correlation coefficient is 0.77 or more. On the other hand, when the light incident angle width "φ" is 15° (degrees), the peak value of the correlation coefficient is less than 0.77. Therefore, it is preferable that the light incident angle width "φ" be 10° (degrees) or less.

Optical Sensor 6

Figure 17A:
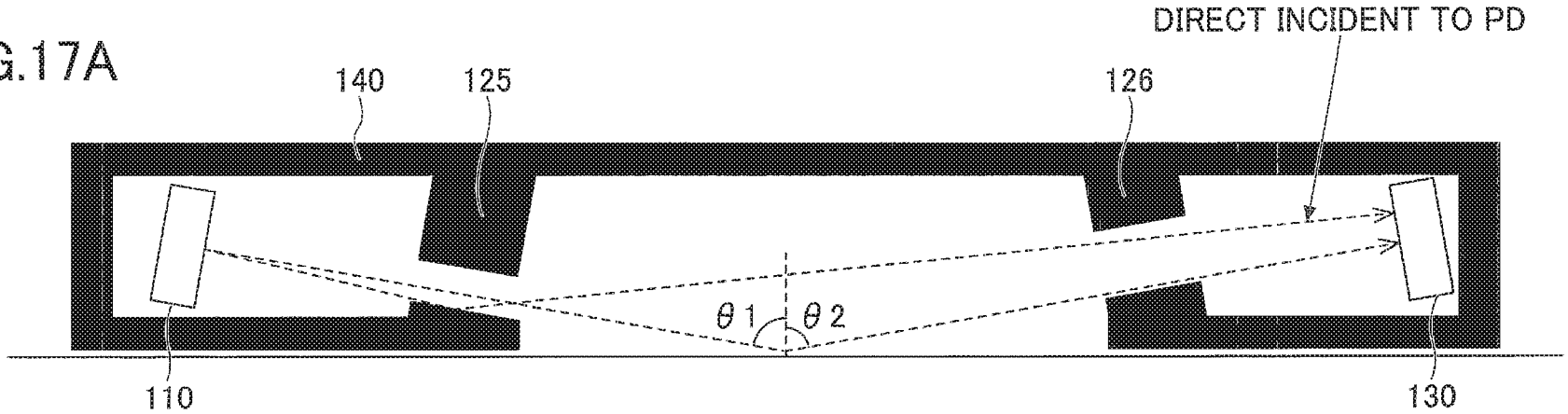
FIGS. 17A and 17B show an optical sensor 6 according to the first embodiment.
Figure 17B:
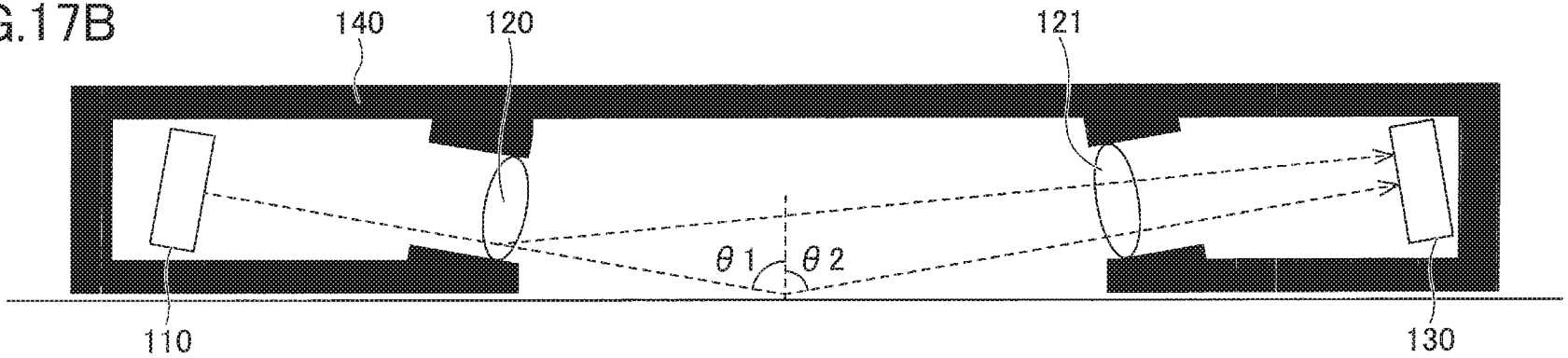

Further, to conduct a highly-accurate detection in the optical sensor, calibration may become necessary. In the optical sensors shown in FIGS. 17A and 17B, the incident angle "θ1" is set to be shallower, so that the light scattered by the collimator lens 120 or an aperture 125 is directly incident to the regular reflection light detector 130. In FIG. 17A, the light scattered by the aperture 125 is incident to the regular reflection light detector 130. In FIG. 17B, the light scattered by the collimator lens 120 is incident to the regular reflection light detector 130.

By doing this, it may become possible that the light emitted from the light source 110 may be directly incident to the regular reflection light detector 130 without using the recording sheet 20. Namely, even when there exists no recording sheet 20, the light from the light source 110 is incident to the regular reflection light detector 130. Therefore, it may become possible to detect a predetermined light amount of the light. By monitoring the light amount, for example, if the light amount is reduced to, for example, paper powers adhered to the collimator lens 120 or the like, the optical fluctuation in such a case may be detected. Specifically, when there is no recording sheet, the light amount "S0" is detected by the regular reflection light detector 130. By using the light amount "S0", as a reference, and the light amount S1 that is acquired when the recording sheet is actually fed and is positioned at the measurement position, the difference (S1−S0) or ratio S1/S0 is calculated. Based on the difference or ratio, it may become possible to conduct the calibration. By doing such calibration before the smoothness of the recording sheet is detected by the optical sensor, it may become possible to detect the smoothness more accurately.

As shown in FIG. 17A, such an optical sensor may include the light source 110, a first aperture 125 through which the light passes emitted from the light source, a second aperture 126 through which the light passes having been passed through the first aperture 125 and reflected by the recording sheet 20, and the regular reflection light detector 130 having a detected surface to which the light having passed through the second aperture 126 is incident and converting the incident light into an electronic signal. Further, as shown in FIG. 17B, such an optical sensor may include the light source 110, a collimator lens 120 through which the light passes emitted from the light source, a collimator lens 121 through which the light passes having been passed through the collimator lens 120 and reflected by the recording sheet 20, and the regular reflection light detector 130 having a detect surface to which the light having passed through the collimator lens 121 is incident and converting the incident light into an electronic signal.

Optical Sensor 7

Figure 18:
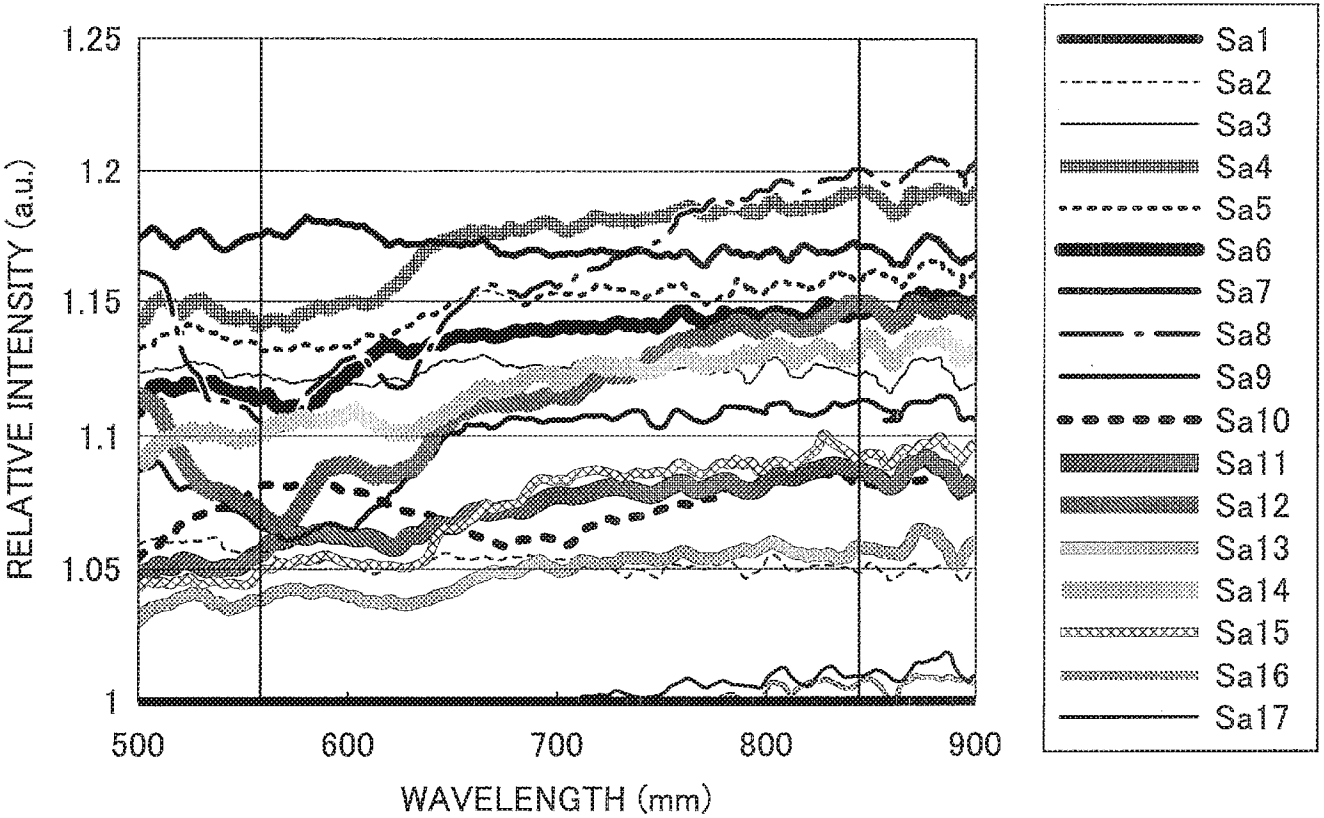
FIG. 18 is a reflection spectrum of the recording sheet.

Further, the regular reflection light on the surface of the recording sheet 20 is detected. Therefore, it is thought that the detection may not be influenced by the optical absorption occurred inside the recording sheet 20. However, when plain paper is used as the recording sheet 20, the scattering may become extremely high. In this case, even when the detection angle "θ2" is set to 80° (degrees), it may become difficult to conduct highly-accurate smoothness detection because of the influence of the light absorption by the fiber of the recording sheet 20. FIG. 18 shows measured spectrums of the recording sheets when the incident angle "θ1" is set to 45° (degrees) and the detection angle "θ2" is set to 0° (degrees) and a lamp light source is used as the light source 110. In FIG. 18, normalized data of seventeen types of sheets (Sa1 through Sa17) are indicated by using the data having the least light amount as a reference. As shown in FIG. 18, fluorescent material amount and type may differ depending on the sheet types and the detected light amount varies depending on the wavelength. Especially, in a range from 500 nm to 750 nm, the detect light amounts vary depending on the wavelength, so that the order of the light amount intensity is changed. On the other hand, in the range greater than or equal to 750 nm, the waveform fluctuation is limited in a stable condition. It is known that the light amount intensity order in this wavelength range indicates high correlation related to the smoothness of the recording sheet 20. Namely, when the wavelength of the light emitted from the light source 110 is greater than or equal to 750 nm, it may become possible to improve the correlative relationship relative to the smoothness in the recording medium 20.

Second Embodiment

Figure 19:
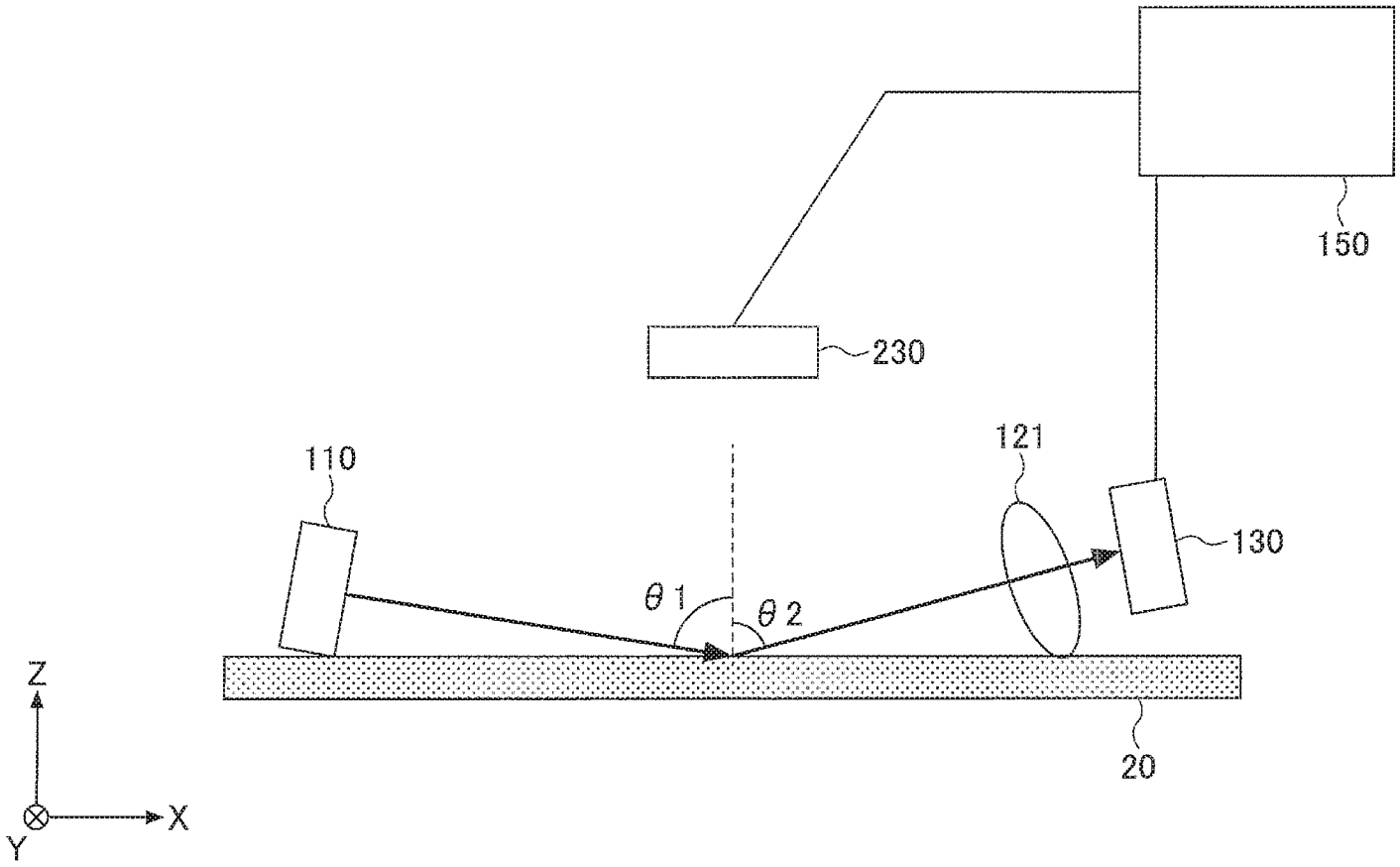
FIG. 19 shows a configuration of an optical sensor according to a second embodiment.

Next, a second embodiment is described. As shown in FIG. 19, the optical sensor in this embodiment includes the light source 110, the collimator lens 120 that collimates the light emitted from the light source 110, the regular reflection light detector 130 (first optical detector) that detects the regular reflection light from the recording medium 20, and a diffuse reflection light detector 230 (second optical detector) that detects the diffuse reflection light from the recording medium 20.

In the optical sensor in this embodiment, the regular reflection light detector 130 (first optical detector) receives only the light that is regularly reflected from the recording medium 20. On the other hand, the diffuse reflection light detector 230 (second optical detector) receives only internal scattered light that is generated by the scattering of the light that is incident inside the recording sheet 20 and the rotation of the polarization direction of the scattered light in the recording sheet 20. The optical sensor in this embodiment determines the type or the like of the recording sheet 20 based on both the information acquired by the regular reflection light detector 130 and the information acquired by the diffuse reflection light detector 230. Therefore, it may become possible to determine the type or the like of the recording medium 20 more accurately.

Further, it may be possible to evaluate the surface state by the regular reflection light detector 130. However, it may not be sufficient to ensure consistency with the smoothness that is acquired based on the air leak test. This is because the smoothness of the recording sheet is thought to be changed depending on an internal air-leak state of the region near the surface of the recording sheet 20.

Next, FIG. 20 shows detection results based on the actual measurements using the regular reflection light detector 130 and the diffuse reflection light detector 230. Here, three points are measured for each of the eleven types of recording media 20. Based on the measured values, a multiple classification analysis is performed using the following formula (1). Here, the symbols "X1" and "X2" denote the signal intensity of the first and second light receiving parts, respectively, and the symbols "a", "b", and "c" denote the first, second, and third coefficients, respectively.

$$Y=aX1+bX2+c \quad (1)$$

Figure 21A:
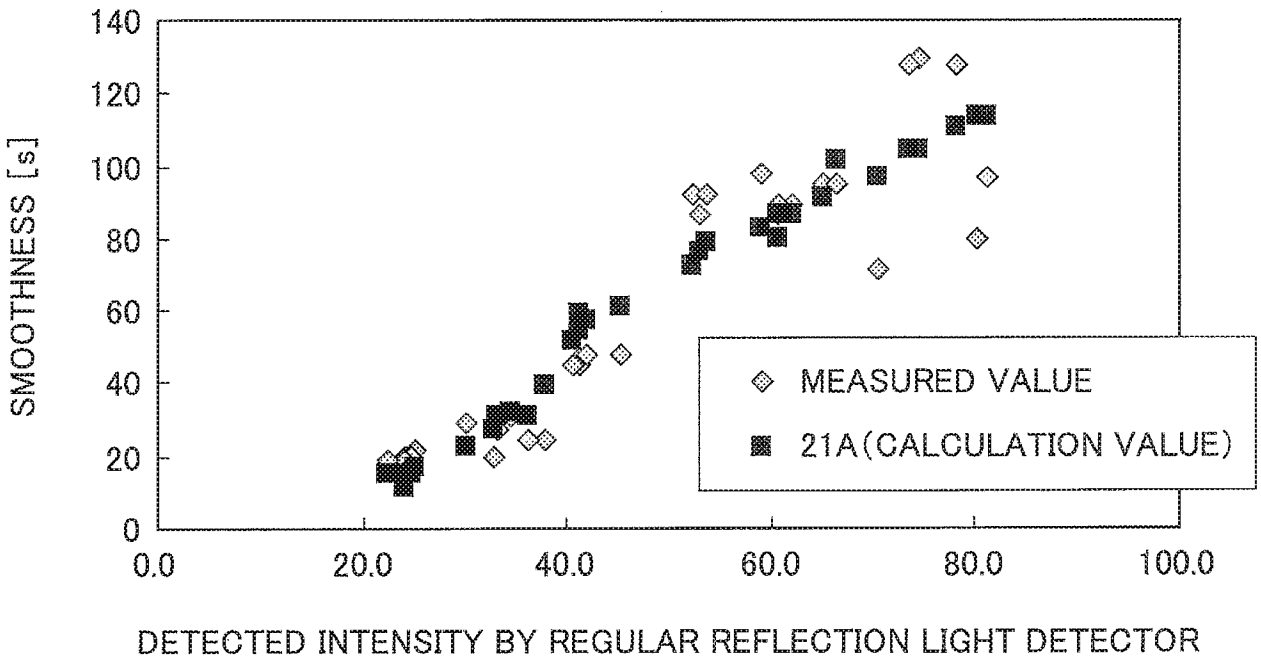
FIGS. 21A and 21B show a configuration of an optical sensor according to the second embodiment.

In this embodiment, an optimization is performed on the first, second, and third coefficients. As a result of the optimization, the first, second, and third coefficients are determined as "a=1.62", "b=−2.85", and "c=81.17", respectively. FIG. 21A shows calculated values Y, which are indicated as "21A", that are acquired based on the above formula (1) using the values of the signal intensities detected by the diffuse reflection light detector 230 and the regular reflection light detector 130, respectively. In this case, the value of the correlative relationship is 0.866 (i.e., $R^2$=0.866).

Figure 21B:
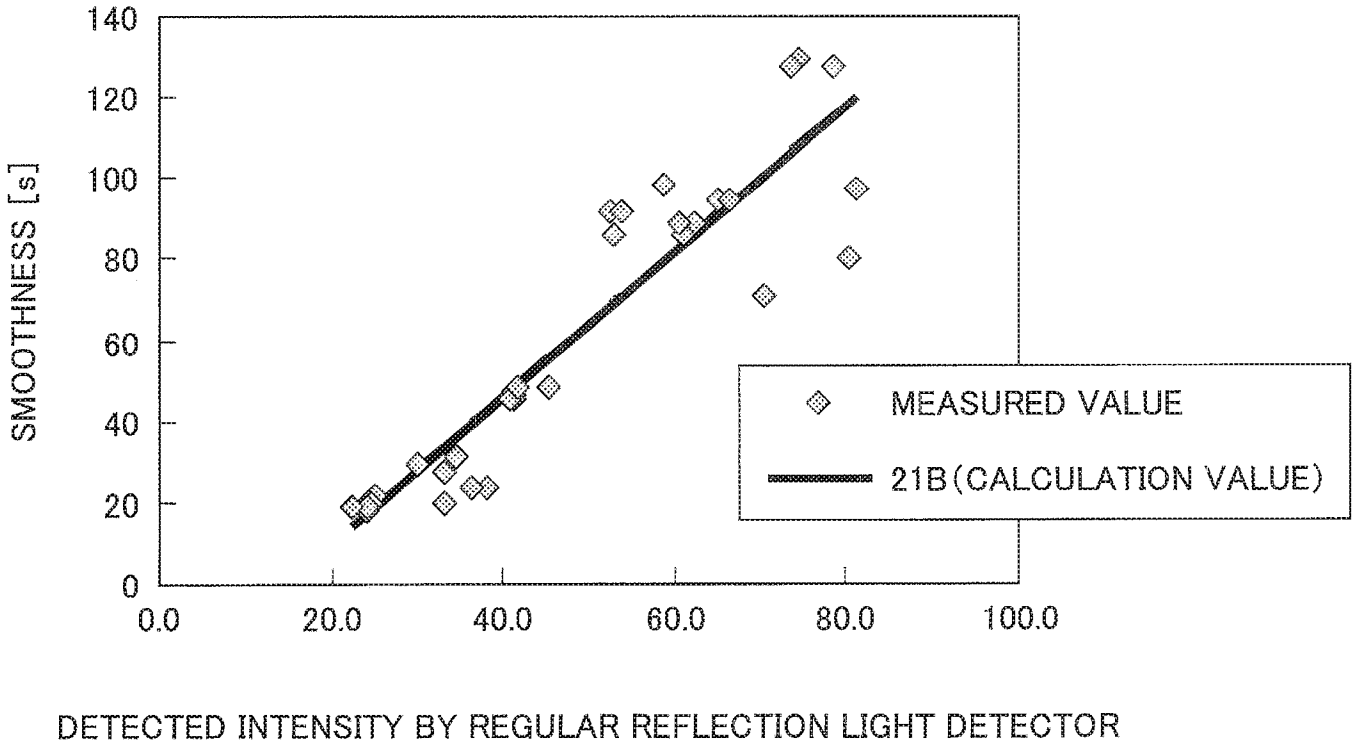

On the other hand, FIG. 21B shows calculated values Y, which are indicated as "21B", that are acquired based on the following formula (2) using the value of the signal intensity detected by the regular reflection light detector 130. Here, the symbols "X1" denotes the signal intensity of the first light receiving part and the symbols "d" and "e" denote the first and second coefficients, respectively. In this case, the value of the correlative relationship is 0.845 (i.e., $R^2$=0.845).

$$Y=dX1+e \quad (2)$$

As described above, when correlative relationship value is calculated based on the above formula (1) by using the signal intensity detected by the diffuse reflection light detector 230, the value of the correlative relationship relative to the smoothness is improved by 0.02. Accordingly, by using the value detected by the regular reflection light detector 130 and the signal intensity detected by the diffuse reflection light detector 230, it may become possible to improve the detection accuracy of the smoothness. This is because as shown in FIG. 1, in the air leak test, the smoothness is determined based on not only the surface state but also the internal state of the recording sheet. Therefore, by additionally considering the internal state by adding the internal data of the recording sheet 20, it is thought that the consistency with the air leak test may be improved and the smoothness of the recording sheet 20 may be detected more accurately.

Controller

Figure 22:
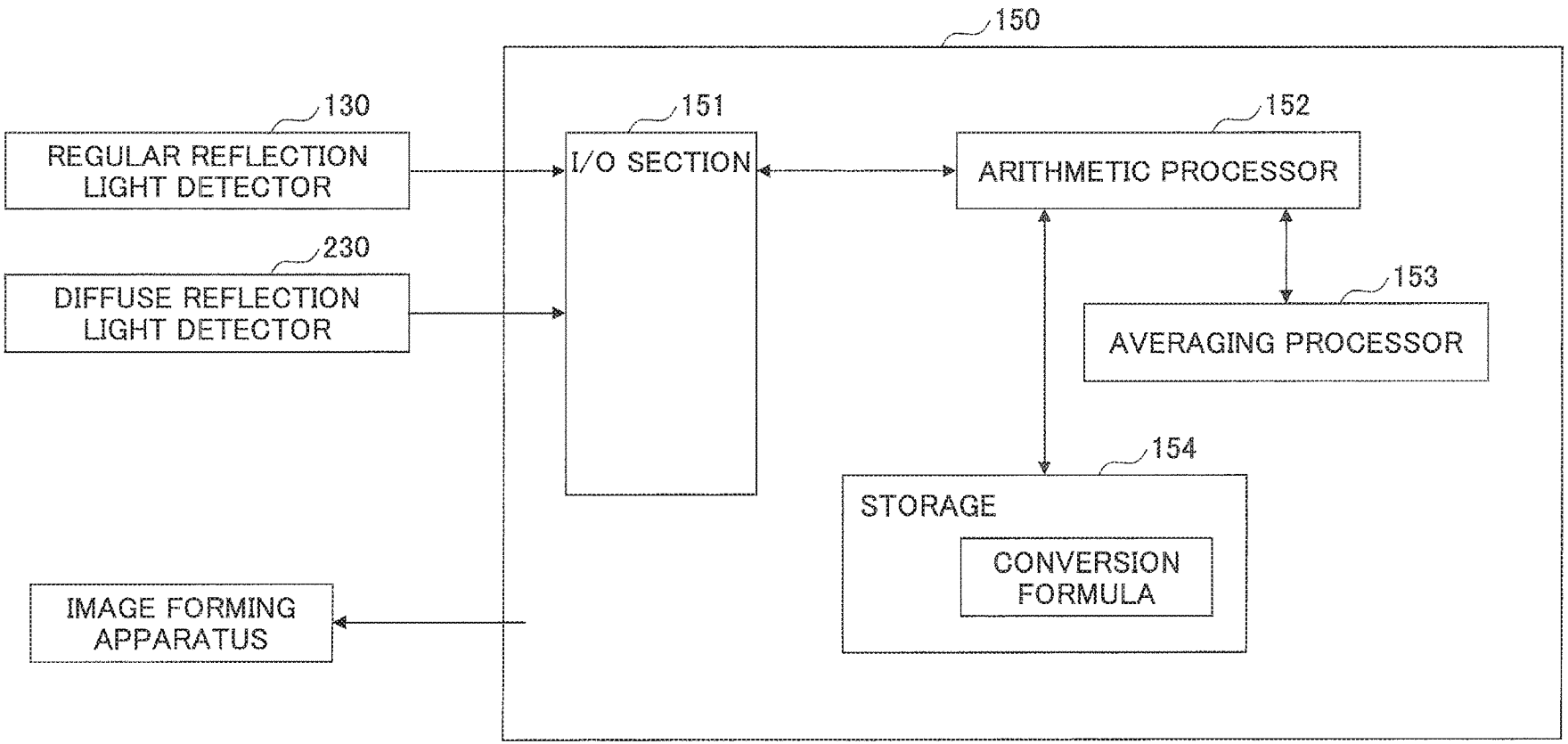
FIG. 22 shows a configuration of the optical sensor according to the second embodiment.

Next, the controller 150 of the optical sensor in this embodiment is described. As shown in FIG. 22, the controller 150 includes the I/O section 151 that performs input/output control on the signals from the regular reflection light detector 130, the diffuse reflection light detector 230 and the like, the arithmetic processor 152 that performs various calculations such as signal processing, the averaging processor 153 that performs the averaging process and the like, and the storage 154 that stores various information. Further, the optical sensor in this embodiment is connected to the image forming apparatus via the controller 150. Further, in the description of this embodiment, the controller 150 is included in the optical sensor. However, the controller 150 may be included in an image forming apparatus including the optical sensor of this embodiment, so as to control the optical sensor in this embodiment.

Detecting Method and the like by Optical Sensor

Figure 23:
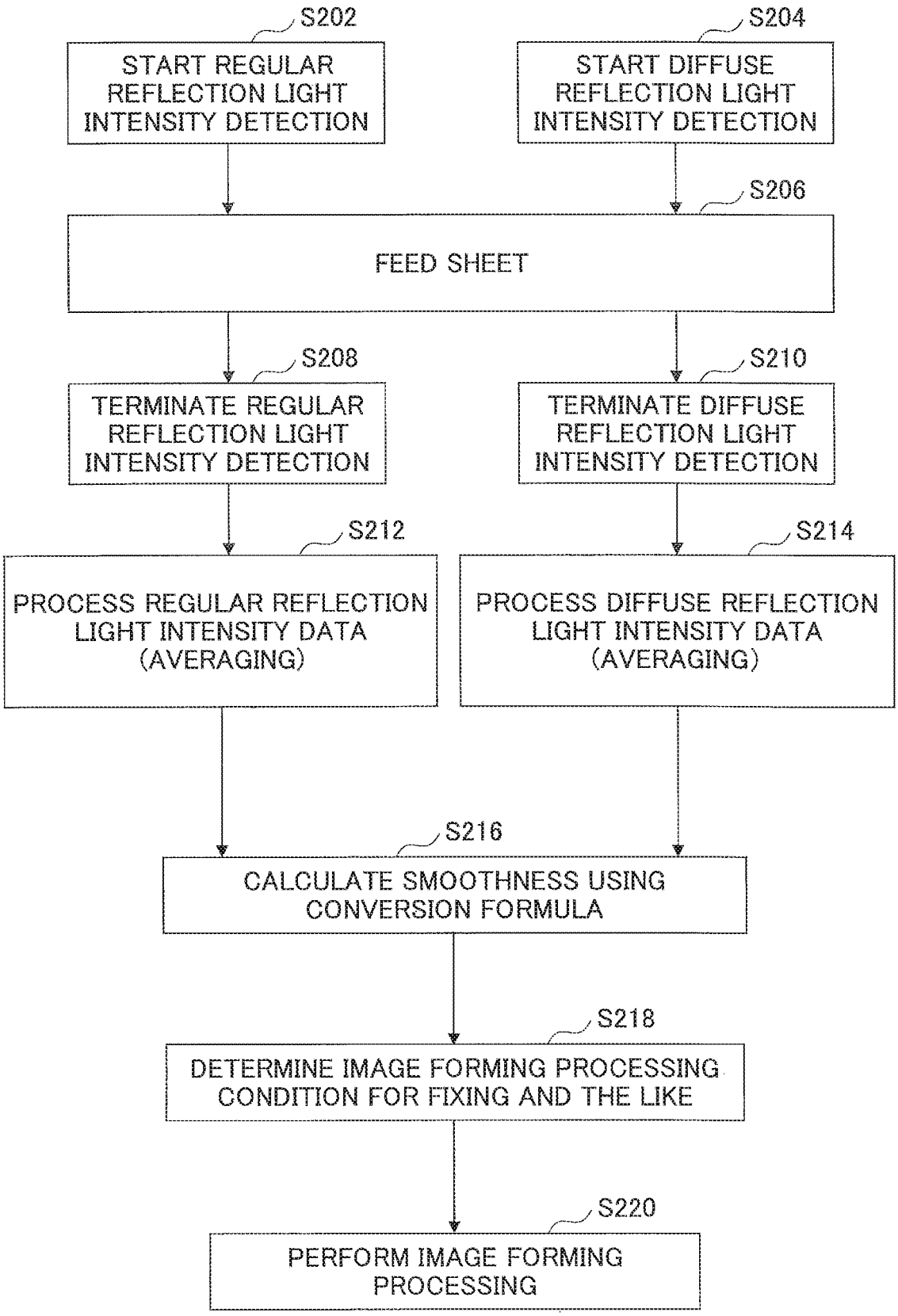
FIG. 23 is a flowchart of a detecting method using the optical sensor according to the second embodiment.

Next, a detecting method and the like by using the optical sensor in this embodiment are described with reference to FIG. 23.

First, as shown in step S202, an operation to detect the regular reflection light intensity by using the optical sensor is started. More specifically, the regular reflection light intensity by using the optical sensor is started by turning on the power or transmitting a signal indicating the start of printing to the image forming apparatus connected to the optical sensor in this embodiment.

Similarly, as shown in steps S204, an operation to detect the diffuse reflection light intensity by using the optical sensor is started. Specifically, the operation starts in the same manner as in step S202.

Next, as shown in step S206, the recording sheet 20 is fed. By feeding the recoding sheet 20 in this way, the light emitted from the light source 110 may be irradiated to the fed recording sheet 20 via the collimator lens 120, so that the regular reflection light reflected from the recording sheet 20 is incident to the regular reflection light detector 130, and the internal diffuse reflection light is incident to the diffuse reflection light detector 230.

Next, as shown in step S208, the measurement of the regular reflection light intensity is terminated and the measurement result is transmitted to the controller 150.

Similarly, as shown in step S210, the measurement of the diffuse reflection light intensity is terminated and the measurement result is transmitted to the controller 150.

Next, as shown in step S212, in the controller 150, an averaging process is performed on the regular reflection light intensity detected by the regular reflection light detector 130. This averaging process is performed by the averaging processor 153 of the controller 150.

Similarly, as shown in step S214, in the controller 150, an averaging process is performed on the diffuse reflection light intensity detected by the diffuse reflection light detector 230. This averaging process is performed by the averaging processor 153 of the controller 150.

Next, as shown in step S216, in the controller 150, the smoothness is calculated based on the averaged regular reflection light intensity and diffuse reflection light intensity. Specifically, the arithmetic processor 152 of the controller 150 calculates the smoothness based on the light intensities using the predetermined conversion formula stored in the storage 154 of the controller 150. As the conversion formula, the above formula (1) is used. Namely, when the regular reflection light intensity detected by the regular reflection light detector 130 and the diffuse reflection light intensity detected by the diffuse reflection light detector 230 are given as X1 (mV) and X2 (mV), respectively, the conversion formula is given as Y=1.62×X1−2.85×X2+81.17. Then, the smoothness Y(sec) is calculated based on this conversion formula.

Next, as shown in step S218, in the controller 150, based on the calculated smoothness, the image forming processing condition used upon fixing in printing the image on the recording sheet 20 in the image forming apparatus is determined. Specifically, based on the relationship between the smoothness and the processing condition shown in FIG. 15, the condition closest to the calculated smoothness is determined as the image forming processing condition upon fixing.

Next, as shown in step S220, in the image forming apparatus, the printing is performed on the recording sheet 20, so that the image is formed on the recording sheet 20.

By doing this, the smoothness may be detected by using the optical sensor in this embodiment, and based on the detected smoothness, it may become possible to set a corresponding printing condition in the image forming apparatus.

The descriptions other than described above in the second embodiment are the same as those in the first embodiment.

Third Embodiment

Figure 24:
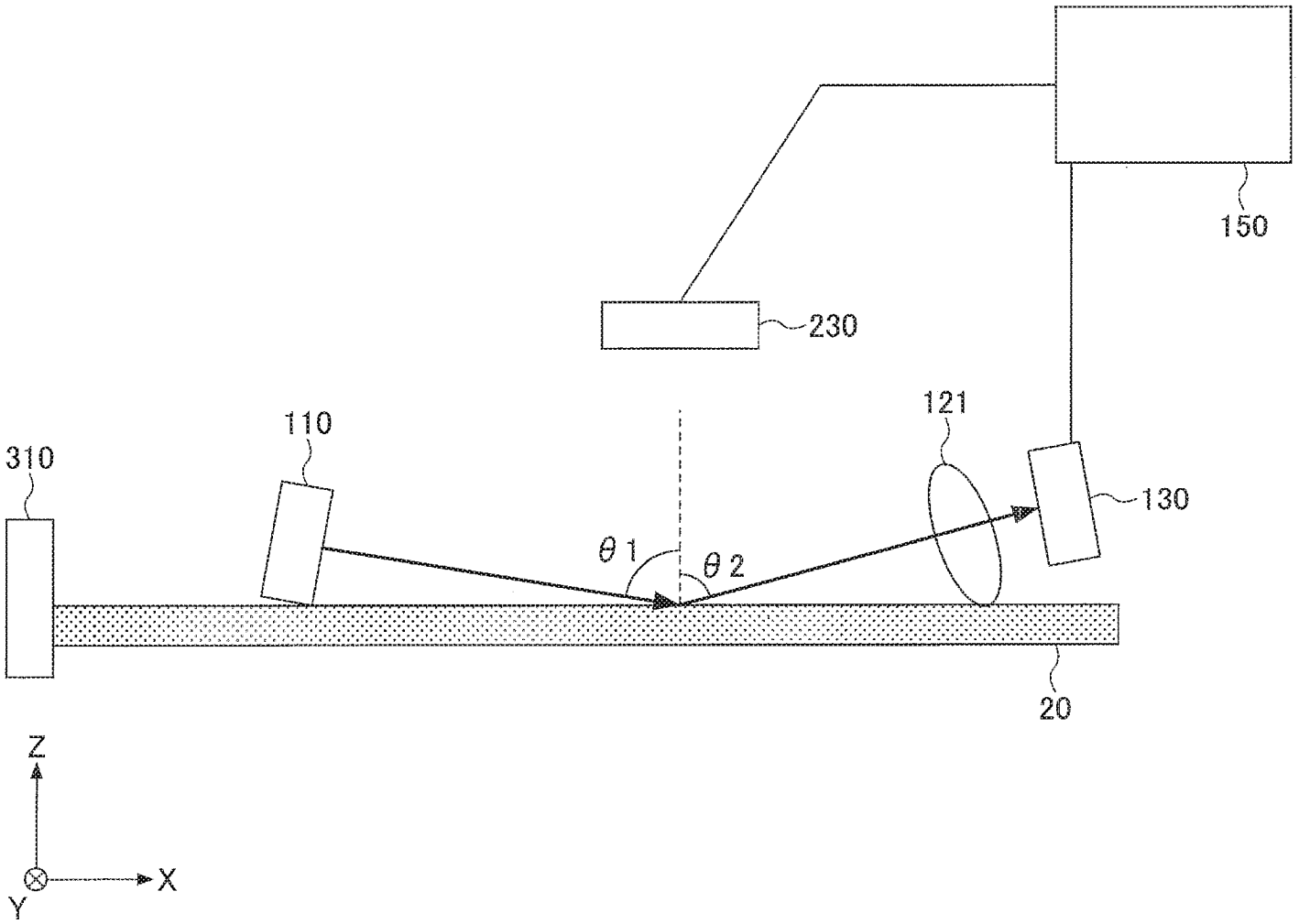
FIG. 24 shows a configuration of an optical sensor according to a third embodiment.

Next, a third embodiment is described. In this embodiment, when compared with the optical sensor in the second embodiment, the optical sensor further includes a sheet thickness measurement sensor to measure the thickness of the recording sheet 20. As shown in FIG. 24, the optical sensor in the third embodiment includes the light source 110, a collimator lens 121 that collimates the regular reflection light from the recording sheet 20, the regular reflection light detector 130 that detects the regular reflection light from the recording medium 20 via the collimator lens 121, the diffuse reflection light detector 230 that detects the diffuse reflection light from the recording medium 20, and a sheet thickness measurement sensor 310 that measures the thickness of the recording sheet 20. By providing the sheet thickness measurement sensor 310, it may become possible to adjust the fluctuation in which the measurement value of the optical sensor varies depending on the thickness of the recording sheet 20. Therefore, it may become possible to determine the type or the like of the recording sheet 20 more accurately.

Further, in this embodiment, a case is described where the sheet thickness measurement sensor 310 is used. However, any other sensor that may measure a physical amount of the recording sheet 20 may alternatively used. For example, as substitute for the sheet thickness measurement sensor 310, a sensor that may measure the sheet density, sheet electrical resistance or the like may be used. Further, an image forming apparatus connected to the sensor in this embodiment may include a database for brands of the sheet types, so that the sheet type may be specified based on the data in the database and the measurement result. The data of the database of the sheet may always be acquired using a communicating function. After specifying the sheet type, by correcting the color of the sheet type, it may become possible to detect the smoothness more accurately.

In the recording sheet 20, color samples and fluorescence materials of the sheet fiber may cause an error. There are more than several hundreds of brands available as sheet types world wide, and the manufacturing method differs depending on each brand. However, colors and fluorescent material amounts are substantially stable for each brand. Therefore, when the brand is determined, it is possible to make corrections. Therefore, by using the sensor in this embodiment, it may become possible to measure the smoothness of the recording sheet 20 more accurately. Accordingly, it may become possible to determine the type or the like of the recording sheet 20 more accurately.

Controller

Figure 25:
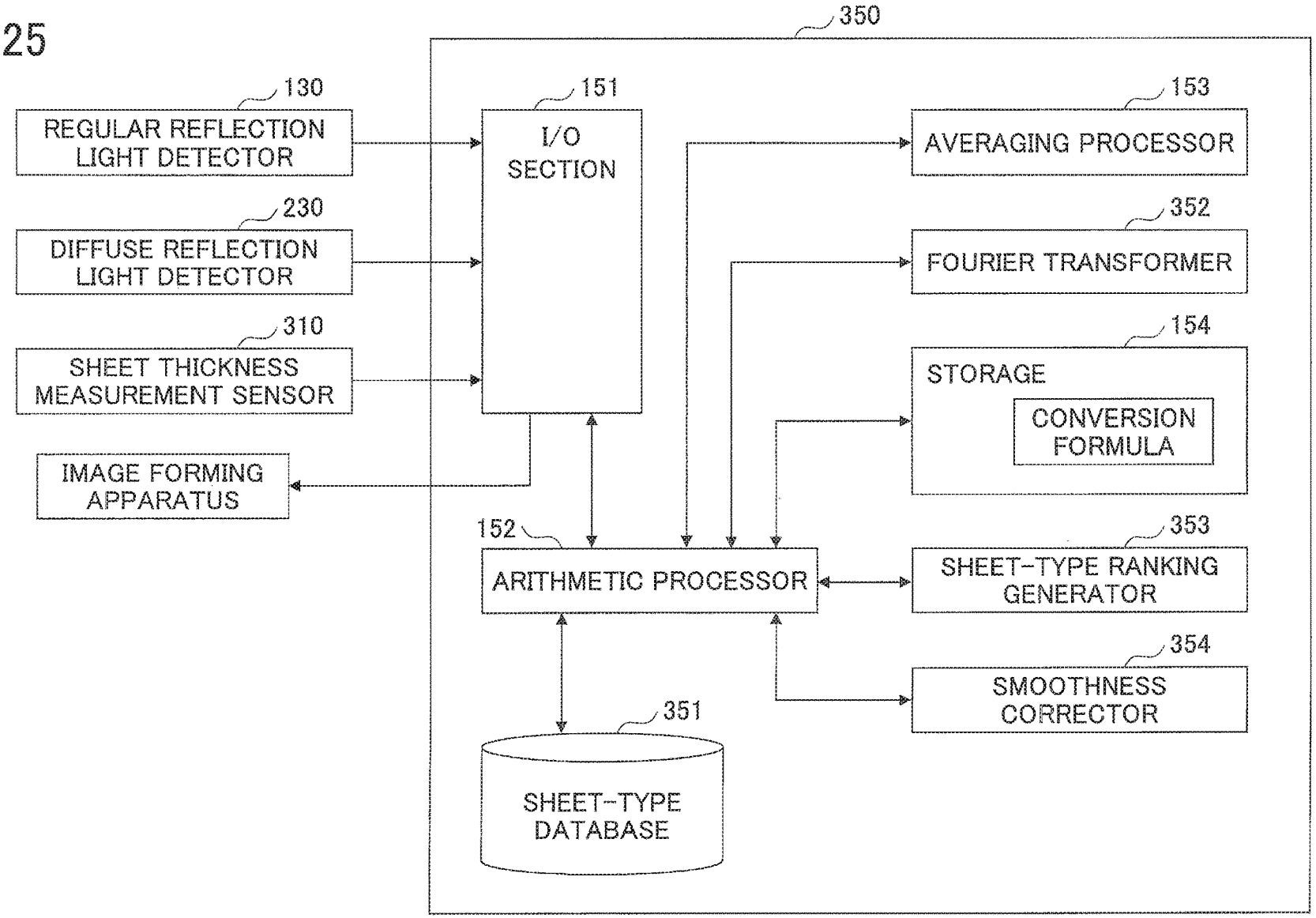
FIG. 25 shows a configuration of the optical sensor according to the third embodiment.

Next, a controller 350 of the sensor in this embodiment is described. As shown in FIG. 25, the controller 350 includes the I/O section 151, which performs input/output control on signals from the regular reflection light detector 13, the diffuse reflection light detector 230, the sheet thickness measurement sensor 310 and the like, the arithmetic processor 152, which performs various calculations such as signal processing, the averaging processor 153, which performs the averaging process, and the storage 154, which stores various information, a sheet-type database 351, a Fourier transformer 352, a sheet-type ranking generator 353, and a smoothness corrector 354. In the Fourier transformer 352, Fourier transformation is performed on the graph indicating in-plane distribution of the recording sheet 20 to calculate a power spectrum in which the horizontal axis indicates the periodicity. The periodicity refers to the in-plane distribution (a.k.a. "texture") unique to the sheet. In the experiment, it is found that when the forming condition is the same, the power spectrum having the same periodicity is indicated. Therefore, the power spectrum is measured for each sheet type and stored as the sheet-type database in the computer. Specifically, the relationship among the sheet type, the data of the regular reflection light detector 130 and the diffuse reflection light detector 230, the sheet thickness, the smoothness and the like are recorded and stored. Then an error between the sheet-type database and the measured value is calculated, and the sheet-type ranking list as shown in FIG. 26 is generated, so that the sheet type having the least error (difference from the error) may be determined as the sheet type of the measured recording sheet 20. Further, the sensor in this embodiment is connected to the image forming apparatus via the controller 350. Further, in the description, the controller 350 is included in the optical sensor. However, the controller 350 may be included in an image forming apparatus including the optical sensor of this embodiment, so as to control the optical sensor in this embodiment.

Detecting Method and the like by Optical Sensor

Figure 27:
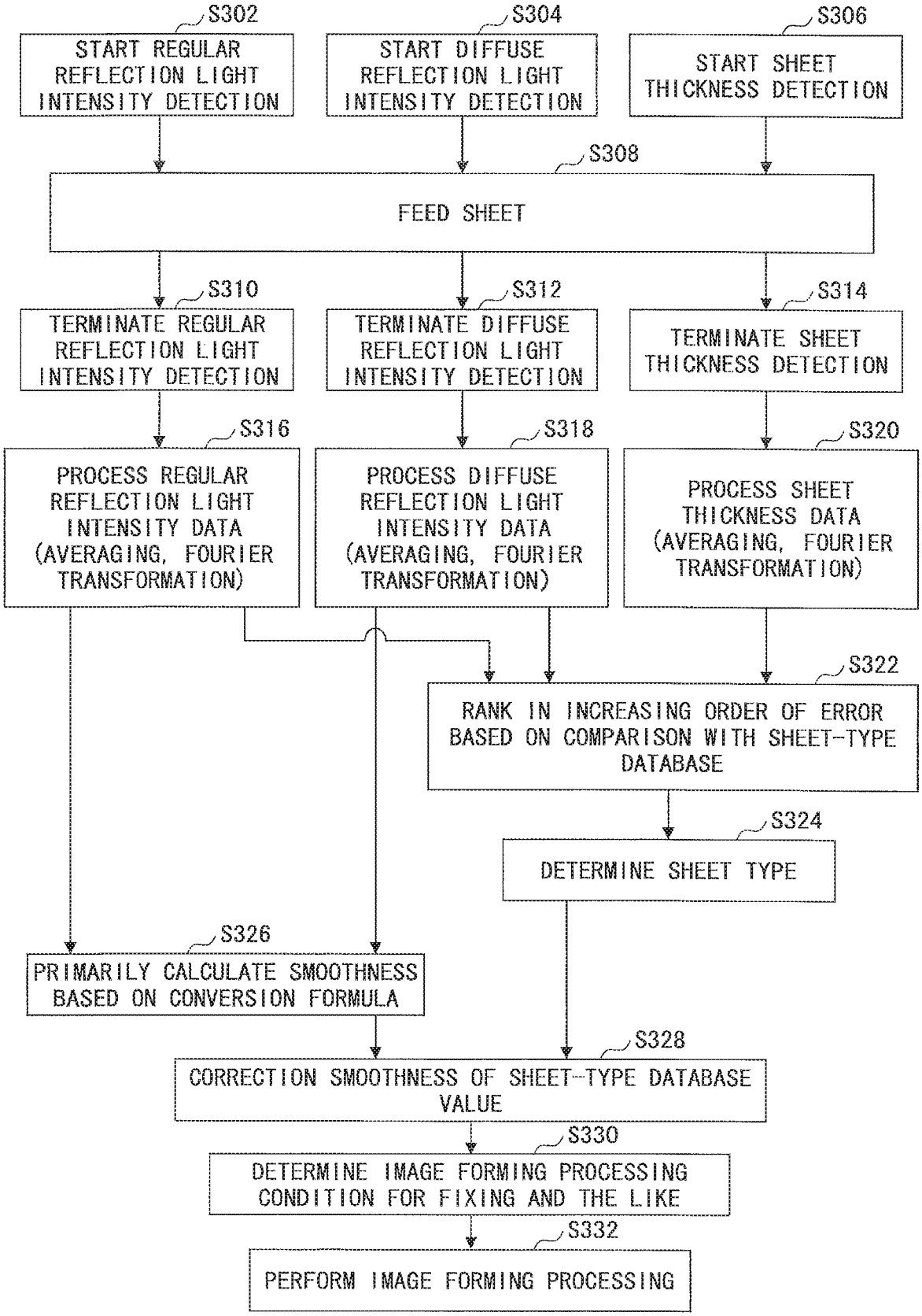
FIG. 27 a flowchart of a detecting method using the optical sensor according to the third embodiment.

Next, a detecting method and the like by using the optical sensor in this embodiment are described with reference to FIG. 27.

First, as shown in step S302, an operation to detect the regular reflection light intensity by using the regular reflection light detector 130 is started. More specifically, the regular reflection light intensity detecting operation is started by turning on the power or transmitting a signal indicating the start of printing to the image forming apparatus connected to the optical sensor in this embodiment.

Similarly, as shown in steps S304, an operation to detect the diffuse reflection light intensity by using the diffuse reflection light detector 230 is started. Specifically, the operation starts in the same manner as in step S302.

Similarly, as shown in step S306, the thickness measurement of the recording sheet 20 by the sheet thickness measurement sensor 310 is started.

Next, as shown in step S208, the recording sheet 20 is fed. By feeding the recoding sheet 20 in this way, the light emitted from the light source 110 may be irradiated to the fed recording sheet 20 via the collimator lens 120, so that the regular reflection light reflected from the recording sheet 20 is incident to the regular reflection light detector 130, and the internal diffuse reflection light is incident to the diffuse reflection light detector 230. Further, the thickness of the recording sheet 20 is measured by the sheet thickness measurement sensor 310.

Next, as shown in step S310, the measurement of the regular reflection light intensity is terminated and the measurement result is transmitted to the controller 350.

Next, as shown in step S312, the measurement of the diffuse reflection light intensity is terminated and the measurement result is transmitted to the controller 350.

Next, as shown in step S314, the measurement of the thickness of the recording sheet 20 is terminated and the measurement result is transmitted to the controller 350.

Next, as shown in step S316, in the controller 350, an averaging process and Fourier transformation are performed on the regular reflection light intensity in the recording sheet 20. Specifically, the averaging process is performed by the averaging processor 153 of the controller 150, and the Fourier transformation is performed by the Fourier transformer 352 of the controller 150.

Similarly, as shown in step S318, in the controller 350, the averaging process and the Fourier transformation are performed on the diffuse reflection light intensity in the recording sheet 20. Specifically, the averaging process is performed by the averaging processor 153, and the Fourier transformation is performed by the Fourier transformer 352.

Similarly, as shown in step S320, in the controller 350, the averaging process and the Fourier transformation are performed on the thickness of the recording sheet 20. Specifically, the averaging process is performed by the averaging processor 153, and the Fourier transformation is performed by the Fourier transformer 352.

Next, as shown in step S322, in the controller 350, based on the information stored in the sheet-type database 351, the sheet-type ranking list as shown in FIG. 26 is generated by using the averaged and Fourier-transformed information of the regular reflection light intensity in the recording sheet 20, the averaged and Fourier-transformed information of the diffuse reflection light intensity in the recording sheet 20, and the averaged and Fourier-transformed information of the thickness in the recording sheet 20.

Next, as shown in step S324, in the controller 350, based on the sheet-type ranking list of FIG. 26, the sheet type having the closest error (i.e., having the least error) is determined as the sheet type of the recording sheet. Specifically, the determination is made by the arithmetic processor 152 and the like.

On the other hand, as shown in step S326, in the controller 350, the smoothness is calculated based on the averaged regular reflection light intensity and diffuse reflection light intensity. Specifically, the arithmetic processor 152 of the controller 350 calculates the smoothness based on the light intensities using a predetermined conversion formula stored in the storage 154 of the controller 350.

Next, as shown in step S328, in the controller 350, based on the determined sheet type and the calculated smoothness, the smoothness is determined. More specifically, the smoothness is determined based on the determined smoothness stored in the sheet-type database 351 and the calculated smoothness.

Figure 16:
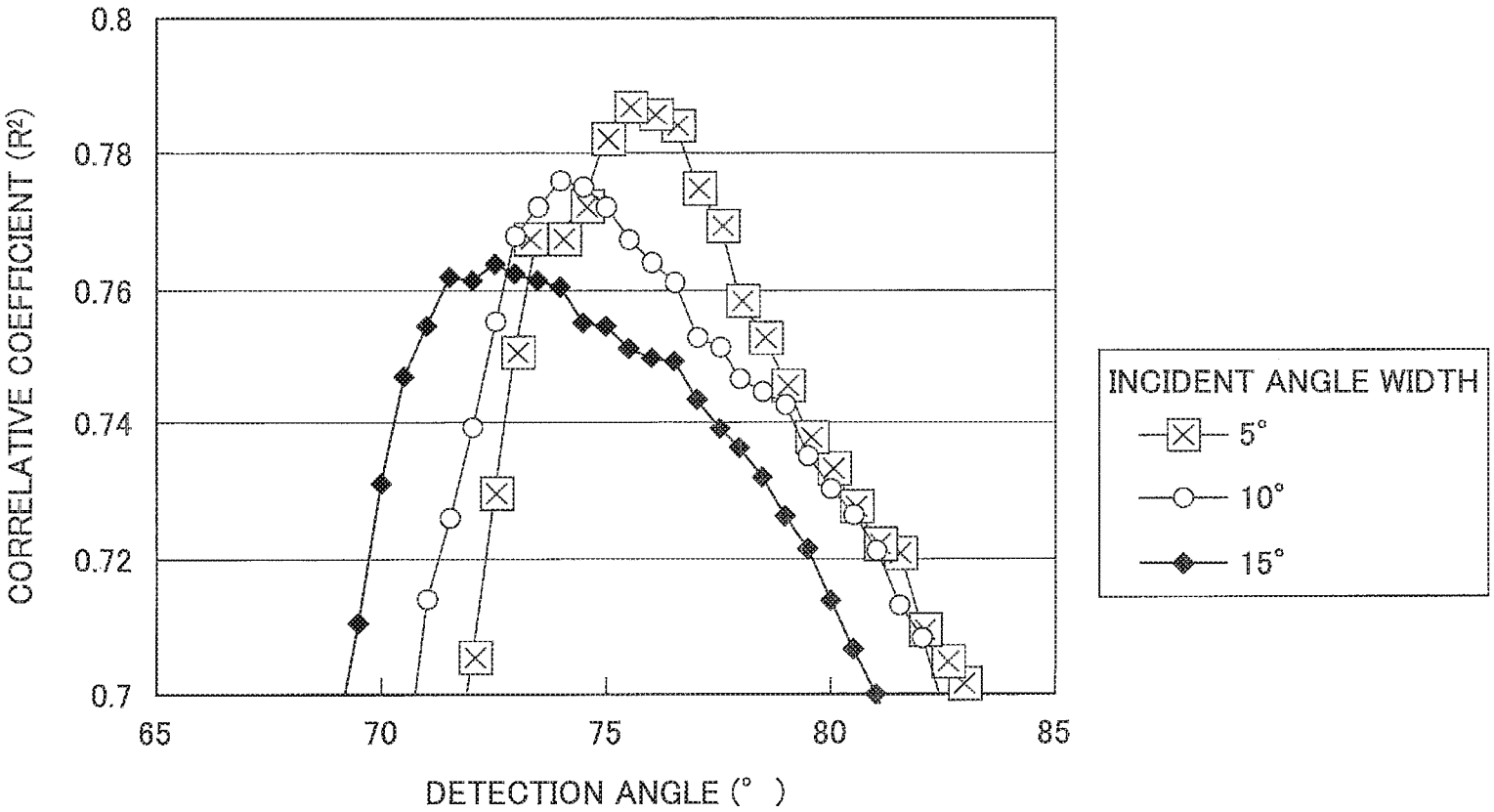
FIG. 16 is a correlation diagram between the detection angle and the detected light amount of an optical sensor 5.

Next, as shown in step S330, in the controller 350, based on the determined smoothness, the image forming processing condition upon fixing in printing the recording sheet 20 by the image forming apparatus. Specifically, based on the relationship between the smoothness and the processing condition in FIG. 16 stored in the storage 154 of the controller 350, the condition closest to the calculated smoothness is determined as the image forming processing condition upon fixing.

Next, as shown in step S332, in the image forming apparatus, the printing is performed on the recording sheet 20, so that the image is formed on the recording sheet 20.

By doing this, the smoothness may be detected by using the optical sensor in this embodiment, and based on the detected smoothness, it may become possible to set a corresponding printing condition in the image forming apparatus.

Figure 28:
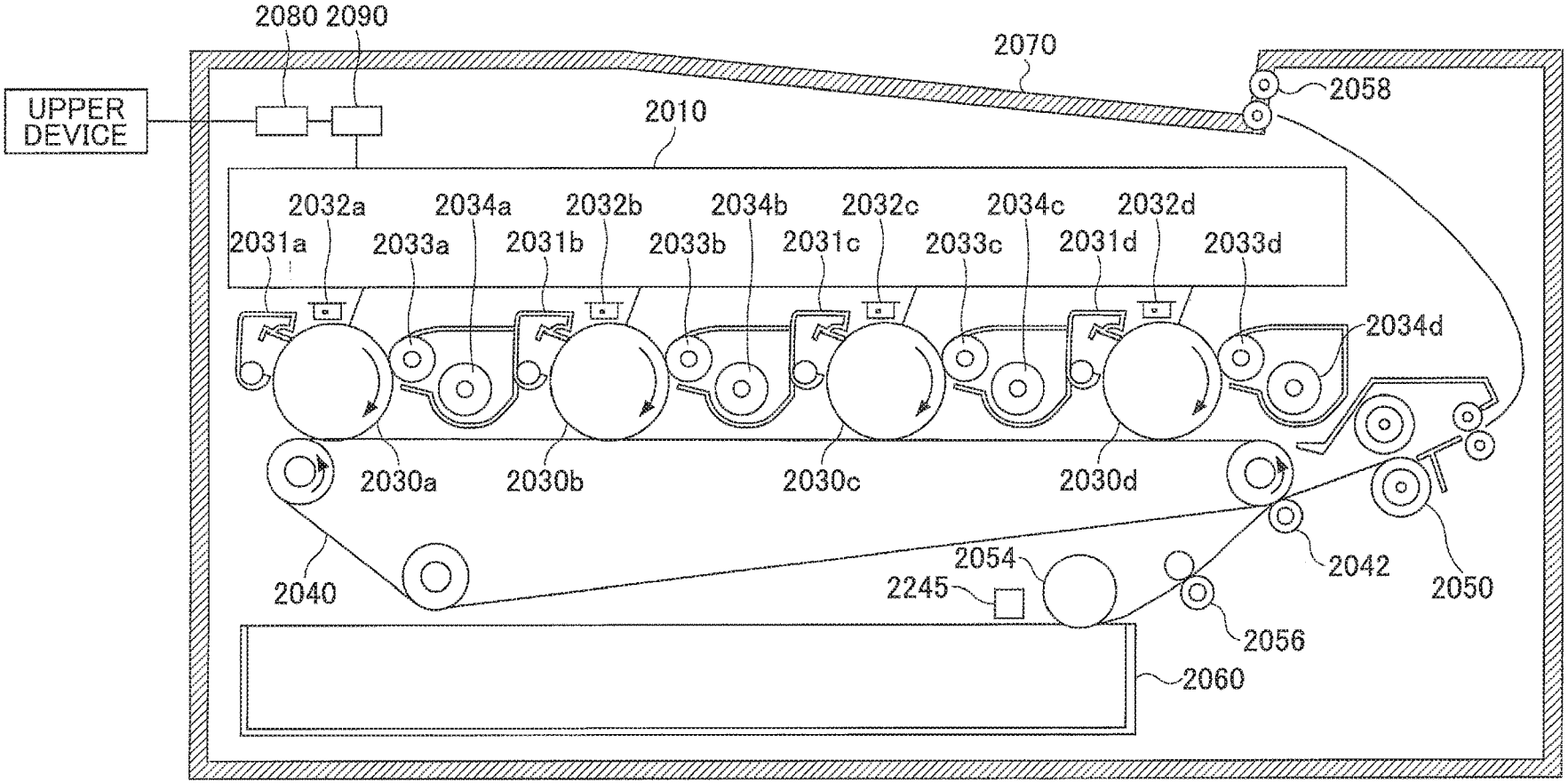
FIG. 28 shows a configuration of an image forming apparatus according to a fourth embodiment.

The descriptions other than described above in the third embodiment are the same as those in the first and second embodiments Fourth Embodiment Next, an image forming apparatus according to a fourth embodiment is described. As the image forming apparatus in this embodiment, a color printer 2000 is described with reference to FIG. 28.

The color printer 2000 is a tandem-type multi-color printer forming a full color image composed of four colors (black, cyan, magenta, and yellow). The color printer 2000 includes an optical scanning device 2010, four photosensitive drums (2030*a*, 2030*b*, 2030*c*, and 2030*d*), four cleaning units (2031*a*, 2031*b*, 2031*c*, and 2031*d*), four charging devices (2032*a*, 2032*b*, 2032*c*, and 2032*d*), four developing rollers (2033*a*, 2033*b*, 2033*c*, and 2033*d*), four toner cartridges (2034*a*, 2034*b*, 2034*c*, and 2034*d*), a transfer belt 2040, a transfer roller 2042, a fixing device 2050, a sheet feeding roller 2054, a resist roller pair 2056, a discharge roller 2058, a sheet feeding tray 2060, a sheet discharging tray 2070, a communication controller 2080, an optical sensor 2245, a printer controller 2090 that collectively control above elements and the like.

The communication controller 2080 controls the bi-directional communications with an upper device (e.g., a personal computer) via a network.

The printer controller 2090 includes a Central Processing Unit (CPU), a Read-Only Memory (ROM), which stores a program described in codes readable by the CPU and various data to be used upon execution of the program, a Random Access Memory (RAM), which serves as a working memory, and an AD converter that converts analog data into digital data. The printer controller 2090 controls elements in response to a request from the upper device and transmits the image information, which is received from the upper device, to the optical scanning device 2010.

The photosensitive drum 2030*a*, the charging device 2032*a*, the developing roller 2033*a*, the toner cartridge 2034*a* and the cleaning unit 2031*a* are used as a group and serve as an image forming station forming a black image (hereinafter may be referred to as "K station" for convenience purposes).

The photosensitive drum 2030*b*, the charging device 2032*b*, the developing roller 2033*b*, the toner cartridge 2034*b* and the cleaning unit 2031*b* are used as a group and serve as an image forming station forming a cyan image (hereinafter may be referred to as "C station" for convenience purposes).

The photosensitive drum 2030*c*, the charging device 2032*c*, the developing roller 2033*c*, the toner cartridge 2034*c* and the cleaning unit 2031*c* are used as a group and serve as an image forming station forming a magenta image (hereinafter may be referred to as "M station" for convenience purposes).

The photosensitive drum 2030*d*, the charging device 2032*d*, the developing roller 2033*d*, the toner cartridge 2034*d* and the cleaning unit 2031*d* are used as a group and serve as an image forming station forming a yellow image (hereinafter may be referred to as "Y station" for convenience purposes).

On each surface of the photosensitive drums, a photosensitive layer is formed. Namely, each surface of the photosensitive drums is a scanning surface to be scanned. Further, it is supposed that the photosensitive drums driven by a rotation mechanism (not shown) to rotate in the arrow direction of FIG. 28.

The charging devices uniformly charge the surfaces of the corresponding photosensitive drums.

The optical scanning device 2010 irradiates light flux, which is modulated for each color based on multi-color image information (i.e., black image information, cyan image information, magenta image information, and yellow image information) transmitted from the upper device, onto the charged surfaces of the corresponding photosensitive drums. By doing this, on the surfaces of the photosensitive drums, charge is removed only in a part to which the light is irradiated, so that a latent image corresponding to the image information is formed on each of the surfaces of the photosensitive drums. The formed latent images are moved to the corresponding developing rollers when the photosensitive drums rotate.

The toner cartridge 2034*a* stores black toner to be supplied to the developing roller 2033*a*. The toner cartridge 2034*b* stores cyan toner to be supplied to the developing roller 2033*b*. The toner cartridge 2034*c* stores magenta toner to be supplied to the developing roller 2033*c*. The toner cartridge 2034*d* stores yellow toner to be supplied to the developing roller 2033*d*.

When the developing rollers rotate, the toner from the corresponding toner cartridges is thinly and uniformly applied onto the surface of the developing rollers. When the toner on the surfaces of the developing rollers is in contact with the surfaces of the corresponding photosensitive drums, the toner is moved and adhered to only the parts of the surfaces where the light was irradiated. Namely, the developing rollers apply the toner to the latent images formed on the surfaces of the corresponding photosensitive drums, so that the latent images are developed. Here, the image to which the toner is adhered (toner image) is moved to the transfer belt 2040 when the photosensitive drums rotate.

The toner images in yellow, magenta, cyan, and black colors are sequentially transferred onto the transfer belt 2040 so as to be overlapped to form a multi-color image.

The sheet feeding tray 2060 stores recording sheets. There is a sheet feeding roller 2054 provided near the sheet feeding tray 2060. The sheet feeding roller 2054 takes the recording sheets from the sheet feeding tray 2060 one by one and feeds the recording sheet to the resist roller pair 2056. The resist roller pair 2056 feeds the recording sheet to a gap between the transfer belt 2040 and the transfer roller 2042 at a predetermined timing. By doing this, the color image on the transfer belt 2040 is transferred onto the recording sheet. The recording sheet on which the image is transferred is fed to the fixing device 2050.

In the fixing device 2050, the recording sheet is heated and pressed, so that the toner is fixed onto the recording sheet. The recording sheet on which the toner is fixed is fed to the sheet discharging tray 2070 via the discharge roller 2058, and is sequentially stacked on the sheet discharging tray 2070.

The cleaning units remove the toner remaining on the surfaces of the corresponding photosensitive drums (remaining toner). The surfaces of the photosensitive drums on which the remaining toner is removed are returned to the positions facing the corresponding charging devices again.

The optical sensor 2245 is used to specify the brand of the recording sheet stored in the sheet feeding tray 2060.

The optical sensor 2245 is the optical sensor according to the first, second, or third embodiment.

The chassis (black box) 160 is a box member made of metal such as aluminum. Further, to reduce the influence of disturbance light or stray light, a black alumite treatment is performed on the surfaces of the black box.

Here, in XYZ three-dimensional orthogonal coordinates, it is assumed that the direction orthogonal to the surface of the recording sheet is z axis direction, and the surface parallel to the surface of the recording sheet is XY plain. Further, it is also supposed that the optical sensor 2245 is disposed on the +Z side of the recording sheet.

Conventionally, the recording sheet is identified by detecting the gloss value of the surface of the recording sheet based on the light amount of the regular reflection light and detecting the smoothness of the recording sheet surface based on a ratio of the light amount of the regular reflection light to the light amount of the diffuse reflection light. On the other hand, in this embodiment, the recording sheet is identified by detecting not only the gloss value and the smoothness but also the information including the thickness and the density, which are other characteristics of the recording sheet, based on the reflection light. Therefore, it may become possible to increase the number of recording sheets to be identified than before.

Further, as described in the third embodiment, by using the third sensor to detect the sheet thickness, it may become possible to improve the accuracy of detecting the sheet type. To detect the sheet thickness, there is a method of, for example, detecting the displacement of the sheet feeding roller using a hall sensor.

For example, based only on the information of the recording sheet surface used in conventional identification method, it may be difficult to distinguish plain paper from a matt coated sheet. In this embodiment, by additionally considering the information indicating the inside of the recording sheet to the information of the surface of the recording sheet, it may become possible to distinguish not only plain paper from a matt coated sheet but also a plurality of brands of recording sheets from a plurality of brands of matt coated sheets.

Further, the data of a plurality of brands of the recording sheets that may be supported by the color printer 2000 may be stored in the ROM of the color printer 2000 by determining optimal developing and transferring conditions in each station for each of the brands of the recording sheets in a process before shipment such as an adjustment process in advance.

The printer controller 2090 performs the sheet-type determination process on the recording sheet when, for example, power of the color printer 2000 is turned on or the recording sheet is supplied in the sheet feeding tray 2060. The sheet-type determination process performed by the printer controller 2090 is described below.

(1) A plurality of light emitting parts of the optical sensor 2245 are turned on simultaneously.
(2) The values of S1 and S2 are acquired based on the output signals from the second optical detector 230 and the first optical detector 130.
(3) The recording sheet determination table is referred to and the brand of the recording sheet is determined based on the acquired S1 and S2 values.
(4) The specified brand of the recording sheet is stored in the RAM, and the sheet-type determination process is terminated.

Upon receiving a printing job request from a user, the printer controller 2090 reads the brand of the recording sheet and acquires optimal developing and transferring conditions corresponding to the brand of the recording sheet from the development and transfer table(s).

Further, the printer controller 2090 controls the development device and the transferring device of the stations in accordance with the acquired optical developing and transferring conditions. For example, the transfer voltage and the toner amount may be controlled. By doing this, it may become possible to form a higher-quality image on the recording sheet.

In this embodiment, the smoothness of the recording sheet may be detected. Therefore, it may become possible to set the optimal condition in accordance to the smoothness of the recording sheet. Accordingly, it may become possible to provide an image forming apparatus with a lower energy consumption.

In this case, it may become possible to eliminate the members to support the light source and the light receiver in their tilted condition and simplify the electronic circuit. Therefore, a compact optical sensor with lower cost may be realized.

Further, in the above embodiment, a case is described where the number of the sheet feeding tray is one. However, the present invention is not limited to this configuration. Two or more sheet feeding trays may be included. In this case, the optical sensor 2245 may be provided for each of the sheet feeding trays.

Further, in the above embodiment, the brand of the recording sheet may be specified during feeding of the recording sheet. In this case, the optical sensor 2245 may be provided near the feeding path of the recoding sheet. For example, the optical sensor 2245 may be provided between the sheet feeding roller 2054 and the resist roller pair 2056.

Further, the target to be identified by the optical sensor 2245 is not limited to the recording sheet.

Further, in the above embodiment, the color printer 2000 is described as the image forming apparatus. However, the image forming apparatus is not limited to the color printer 2000. For example, the image forming apparatus may be an optical plotter, a digital copier or the like.

Further, in the above embodiment, a case is described where the image forming apparatus includes four photosensitive drums. However, the present invention is not limited to this configuration.

Further, the optical sensor 2245 may be applied to an image forming apparatus that forms an image by ejecting ink onto the recording sheet.

Further, the target to be identified by the optical sensor describes in the above embodiment is not limited to the recording sheet.

Although the invention has been described with respect to specific embodiments for a complete and clear disclosure, the appended claims are not to be thus limited but are to be construed as embodying all modifications and alternative constructions that may occur to one skilled in the art that fairly fall within the basic teachings herein set forth.

The present application is based on and claims the benefit of priority of Japanese Patent Application No. 2012-187596 filed Aug. 28, 2012, the entire contents of which are hereby incorporated herein by reference.

DESCRIPTION OF THE REFERENCE NUMERALS

20: RECORDING SHEET
110: LIGHT SOURCE
120: COLLIMATOR LENS
121: LENS
130: REGULAR REFLECTION LIGHT DETECTOR (FIRST OPTICAL DETECTOR)
150: CONTROLLER
151: I/O SECTION
152: ARITHMETIC PROCESSOR
153: AVERAGING PROCESSOR
154: STORAGE
160: CHASSIS
161: OPENING
230: DIFFUSE REFLECTION LIGHT DETECTOR (SECOND OPTICAL DETECTOR)
2000: COLOR PRINTER (IMAGE FORMING APPARATUS)

PATENT DOCUMENTS

Patent Document 1: Japanese Laid-Open Patent Application No. 2002-340518
Patent Document 2: Japanese Laid-Open Patent Application No. 2003-292170
Patent Document 3: Japanese Laid-Open Patent Application No. 2005-156380
Patent Document 4: Japanese Laid-Open Patent Application No. H10-160687
Patent Document 5: Japanese Laid-Open Patent Application No. 2006-62842
Patent Document 6: Japanese Laid-Open Patent Application No. H11-249353
Patent Document 7: Japanese Laid-Open Patent Application No. H08-5573
Patent Document 8: Japanese Patent No. 3349069

The invention claimed is:

1. An optical sensor, comprising:

a light source configured to emit light having a wavelength that is greater than or equal to 750 nm;

a first optical detector configured to detect an intensity of light that is reflected by an object, the light being emitted from the light source and irradiated onto the object, wherein when an incident angle of the light incident to the object from the light source relative to a normal line of the object is $\theta 1$, and a detection angle of the light reflected from the object and incident to the first optical detector relative to the normal line of the object is given as $\theta 2$, the light source and the first optical detector are arranged so that $\theta 1 > \theta 2$;

a second optical detector configured to detect an internal diffuse reflection light among the reflected light at a position where the light is irradiated onto the object; and circuitry configured to calculate a smoothness of the object based on a combination of both a light amount detected by the first optical detector and a light amount detected by the second optical detector.

2. The optical sensor according to claim 1, further comprising:

a lens provided between the object and the first optical detector.

3. The optical sensor according to claim 2, wherein an incident angle width of the light incident to the first optical detector due to the lens is less than or equal to 10°.

4. The optical sensor according to claim 1, wherein an aperture is provided between the light source and the object or between the object and the first optical detector.

5. An image forming apparatus forming an image on a recording medium, the apparatus comprising:

the optical sensor of claim 1.

6. The optical sensor of claim 1, wherein the object is a recording medium.

7. An optical sensor, comprising:

a light source;

a first optical detector configured to detect intensity of light that is reflected by a target, the light emitted from the light source and irradiated onto the target, wherein when an incident angle of the light incident to the target from the light source relative to a normal line of the target is given as $\theta 1$, a formula $75° \leq \theta 1 \leq 85°$ is satisfied, and a position where the light from the light source is reflected at the target is disposed to be closer to the first optical detector than to the light source; and a second optical detector configured to detect a diffuse reflection light in the light reflected at the position, wherein the target is identified based on a light amount detected by the first optical detector and a light amount of the diffuse reflection light detected by the second optical detector.

8. The optical sensor according to claim 7, further comprising:

a lens provided between the target and the first optical detector.

9. The optical sensor according to claim 8, wherein an incident angle width of the light incident to the first optical detector due to the lens is less than or equal to 10°.

10. The optical sensor according to claim 7, wherein an aperture is provided between the light source and the target or between the target and the first optical detector.

11. The optical sensor according to claim 7, wherein a collimator lens is provided between the light source and the target.

12. The optical sensor according to claim 1, wherein a collimator lens is provided between the light source and the target.

13. An optical sensor, comprising:

a light source configured to emit light having a wavelength that is greater than or equal to 750 nm;

a first optical detector configured to detect an intensity of light that is reflected by an object, the light being emitted from the light source and irradiated onto the object, wherein when an incident angle of the light incident to the object from the light source relative to a normal line of the object is θ1, and a detection angle of the light reflected from the object and incident to the first optical detector relative to the normal line of the object is given as θ2, the light source and the first optical detector are arranged so that θ1>θ2; and a second optical detector configured to detect an internal diffuse reflection light among the reflected light at a position where the light is irradiated onto the object, wherein the object is identified by a light amount detected by the first optical detector and a light amount detected by the second optical detector; and an aperture is provided between the light source and the object or between the object and the first optical detector.

* * * * *